US010233664B2

(12) United States Patent
Choi

(10) Patent No.: US 10,233,664 B2
(45) Date of Patent: Mar. 19, 2019

(54) TENT AND TENT FRAME WITH ILLUMINATION

(71) Applicants: Kwan Jun Choi, Xiamen (CN); Campvalley (Xiamen) Co. Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/516,875

(22) PCT Filed: Sep. 23, 2016

(86) PCT No.: PCT/IB2016/001478

§ 371 (c)(1),
(2) Date: Apr. 4, 2017

(87) PCT Pub. No.: WO2017/051253

PCT Pub. Date: Mar. 30, 2017

(65) Prior Publication Data

US 2018/0202185 A1 Jul. 19, 2018

(30) Foreign Application Priority Data

Sep. 24, 2015 (CN) ..... 2015 2 0745019
Apr. 25, 2016 (CN) ..... 2016 2 0350608
Jul. 13, 2016 (CN) ..... 2016 2 0734588

(51) Int. Cl.
*E04H 15/10* (2006.01)
*E04H 15/50* (2006.01)
(Continued)

(52) U.S. Cl.
CPC ..... *E04H 15/10* (2013.01); *E04H 15/50* (2013.01); *F21S 9/032* (2013.01); *F21V 23/002* (2013.01); *F21Y 2115/10* (2016.08)

(58) Field of Classification Search
CPC ..... E04H 15/50; E04H 15/10
See application file for complete search history.

(56) References Cited

U.S. PATENT DOCUMENTS 4,817,044 A * 3/1989 Ogren ..... A61M 5/172 702/187
6,089,727 A * 7/2000 Wu ..... A45B 3/04 135/910

(Continued)

FOREIGN PATENT DOCUMENTS

CN 200949757 Y 9/2007
CN 201924648 U 8/2011

(Continued)

OTHER PUBLICATIONS

International Search Report, dated Mar. 2, 2017 for PCT/IB2016/001478. 4 pgs.

*Primary Examiner* — Noah Chandler Hawk
(74) *Attorney, Agent, or Firm* — Morgan, Lewis & Bockius LLP

(57) ABSTRACT

Disclosed are tents and tent frames with illumination. A tend frame includes a plurality of upper supporting poles (2), first connector (3) pivotally connecting the upper supporting poles (2) and a control box (4) disposed below the first connector (3) when the tent frame is unfold. The plurality of upper supporting poles (2) include one or more illumination supporting poles, each comprising an illumination groove (21) and an illumination source disposed in the illumination groove (21). The illumination groove (21) is elongated along the illumination supporting pole. The control box comprises a first PCB board (44) electrically coupled to the illumination source of each illumination supporting pole and electrically coupled to a battery set, an external power source, or a combination of the battery set and the external power source.

21 Claims, 20 Drawing Sheets

(51) Int. Cl.

| | |
|---|---|
| ***F21S 9/03*** | (2006.01) |
| ***F21V 23/00*** | (2015.01) |
| *F21Y 115/10* | (2016.01) |

(56) References Cited

U.S. PATENT DOCUMENTS

| | | | | |
|---|---|---|---|---|
| 6,439,249 | B1 * | 8/2002 | Pan | A45B 3/04 135/16 |
| 6,773,140 | B2 * | 8/2004 | Lee | E04H 15/10 135/121 |
| 7,311,113 | B2 | 12/2007 | Suh | |
| 7,455,427 | B1 | 11/2008 | Freeman | |
| 7,562,667 | B2 * | 7/2009 | Li | A45B 3/04 135/21 |
| 2003/0084931 | A1 | 5/2003 | Lee | |
| 2008/0000513 | A1 | 1/2008 | Lee | |
| 2008/0029141 | A1 | 2/2008 | Grand | |
| 2008/0072945 | A1 * | 3/2008 | Grand Pre | E04H 15/10 135/91 |
| 2013/0271966 | A1 * | 10/2013 | Doble | A45B 3/04 362/183 |
| 2015/0034137 | A1 * | 2/2015 | Tanaeim | E04H 15/10 135/91 |
| 2017/0292285 | A1 * | 10/2017 | Jin | F21V 23/04 |

FOREIGN PATENT DOCUMENTS

| | | | |
|---|---|---|---|
| CN | 203684790 | U | 7/2014 |
| CN | 204492319 | U | 7/2015 |
| CN | 204627108 | U | 9/2015 |
| CN | 204691386 | U | 10/2015 |
| CN | 205025192 | U | 2/2016 |
| CN | 205591637 | U | 9/2016 |
| CN | 205743243 | U | 11/2016 |
| CN | 205840492 | U | 12/2016 |
| CN | 206035078 | U | 3/2017 |
| CN | 206035080 | U | 3/2017 |
| WO | 2012/088973 | A1 | 7/2012 |
| WO | WO 2015/183926 | A1 | 12/2015 |

* cited by examiner

TENT AND TENT FRAME WITH ILLUMINATION

CROSS-REFERENCE TO RELATED APPLICATIONS

The present application claims priority of Chinese Utility Model Applications CN 201520745019.9 filed on Sep. 24, 2015, CN 201620350608.1 filed Apr. 25, 2016, and CN 201620734588.8 filed on Jul. 13, 2016, the entire contents of which application are incorporated herein for all purposes by this reference.

FIELD OF THE INVENTION

The present invention generally relates to tent and tent frames, and more particularly, relates to tent and tent frames with illumination.

BACKGROUND

Most existing tents do not have illumination means. If illumination is desired, in particular at night, one often needs to set up a lighting device (e.g., a lamp) and connect the lighting device to a power source or power facility outside of the tent. It is inconvenient, time-consuming and cumbersome. In some cases, for instance when a power source or power facility outside of the tent is not available, the tent cannot provide desired illumination at all.

Given the current state of the art, there remains a need for tent frames and tents that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide tent and tent frames with illumination.

In some embodiments, the present invention provides a tent frame comprising a plurality of upper supporting poles pivotally connected to a first connector. The plurality of upper supporting poles comprises one or more illumination supporting poles, each comprising an illumination groove and an illumination source. The illumination groove is elongated along a longitudinal direction of the illumination supporting pole, and at a lower side of the illumination supporting pole when the tent frame is unfolded. The illumination source is disposed in the elongated illumination groove. The tent frame also includes a control box controlling operation of the illumination source of each illumination supporting pole. The control box is disposed below the first connector when the tent frame is unfolded, and comprises a first printed circuit board (PCB) electrically coupled to the illumination source of each illumination supporting pole. The control PCB board of the control box is configured to be electrically connected to a battery set, an external power source, or a combination of the battery set and the external power source. In an embodiment, the control box further comprises a plurality of battery compartments, each for housing a battery of the battery set. In an embodiment, the tent frame further includes a battery box housing the battery set, and coupled with the control box.

In some embodiments, each illumination supporting pole further comprises a translucent cover coupled with the elongated illumination groove to encase the illumination source. In some embodiments, the illumination source is an LED lighting strip. In some embodiments, the tent frame further includes a remote control wirelessly connected to the control box to control the operation of the illumination source of each illumination supporting pole. In some embodiments, the tent frame further includes a top cover disposed above the first connector and coupled to the first connector. In some embodiments, the control box further comprises a control button to control the operation of the illumination source of each illumination supporting pole. In some embodiments, the control box further comprises a mounting plate, wherein the control PCB board is fixedly coupled to the mounting plate.

In some embodiments, the illumination source of each illumination supporting pole comprises a first interface at an end adjacent the first connector. The first connector comprises a receiving compartment at a lower side of the first connector. The control box comprises a protrusion compartment. Corresponding to the illumination source of each illumination supporting pole, the control box further comprises a second interface disposed at the protrusion compartment of the control box, and a first electrical line connecting the control PCB board with the second interface. The first interface of the illumination source of each illumination supporting pole is electrically connected to the corresponding second interface disposed in the protrusion compartment of the control box.

In some embodiments, the protrusion compartment is formed at an upper side of the control box and configured to be coupled with the receiving compartment of the first connector. The control box further comprises a passage, a plurality of battery compartments and a plurality of battery covers. The passage is connected to the protrusion compartment to allow the first electrical line pass through. The plurality of battery compartments, each for housing a battery of the battery set, is disposed circumferentially around the passage. Each battery cover is rotatably coupled with a corresponding battery compartment at a first side thereof and releasably coupled with the corresponding battery compartment at a second side thereof.

In some embodiments, the control box further comprises a control inner part and a control outer casing. The control inner part comprise a plurality of battery compartments disposed circumferentially around the protrusion compartment, each for housing a battery of the battery set. The control outer casing covers the control inner part and batteries housed in the battery compartments, and removably coupled with the first connector. In an embodiment, the first connector comprises a sliding groove, and a stopper disposed at an outer side of the sliding groove. The control outer casing comprises a positioning button at an upper outer side thereof and slidable along the sliding groove of the first connector. The positioning button comprises a positioning protrusion configured to be releasably coupled with the stopper of the first connector. In an embodiment, the control box further comprises a control button under the control PCB board to control the operation of the illumination source of each illumination supporting pole. The push button is accessible from outside of the control outer casing.

In some embodiments, the control box comprises a control casing coupled with the first connector, with the control PCB board disposed in the control casing. The tent frame further comprises a battery box disposed below the control box when the tent is unfolded. The battery box comprises a battery outer casing and a battery inner part. The battery outer casing is coupled to the control casing of the control box and comprising a rotatable knob. The battery inner part is insertable into and removable from the battery outer casing from a bottom of the battery outer casing. The battery inner part comprises an opening to allow the rotatable knob to pass through, and a plurality of battery compartments disposed around the opening, each for housing a battery of the battery set. The rotatable knob is configured to abut a bottom of the battery inner part, thereby releasably coupling the battery inner part with the battery outer casing.

In some embodiments, the tent frame further includes an external power interface for connecting with the external power source. The external power interface is configured to be mounted at one of the plurality of upper supporting poles or at a lower supporting pole, and comprises an external power interface PCB board electrically connected with the control PCB board of the control box. In an embodiment, the external power interface PCB board comprises a USB interface for connecting with the external power source. In an embodiment, the external power source is a mobile power pack or a solar cell.

In some embodiments, the external power interface further comprises an interface outer casing for housing the external power interface PCB board, and a second electrical line connecting the external power interface PCB board of the external power interface with the control PCB board of the control box, thereby providing power supply to the control box. In some embodiments, the external power interface further comprises an interface push button, and additionally or optionally, an interface cover. The interface push button is for controlling the power supply to the control box. The interface push button is disposed on a side of the external power interface PCB board and corresponding to a switch on the external power interface PCB board. The additional or optional cover is disposed on an outer side of the interface push button and coupled with the interface outer casing.

In some embodiments, the tent frame further includes a Bluetooth speaker disposed below the control box. The Bluetooth speaker comprises a speaker PCB board electrically connected to the external power interface PCB board of the external power interface, and one or more speakers connected to the speaker PCB board. In an embodiment, the Bluetooth speaker further comprises a speaker upper cover coupled with the control box, a speaker outer casing coupled with the speaker upper cover, and a PCB mounting plate disposed in the speaker outer casing. The speaker PCB board is mounted on the mounting plate. In an embodiment, the Bluetooth speaker is wirelessly connected to a mobile device, which controls a play of the Bluetooth speaker via Bluetooth technology.

In some embodiment, the present invention provide a tent having the tent frame of the present invention.

Exemplary systems of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
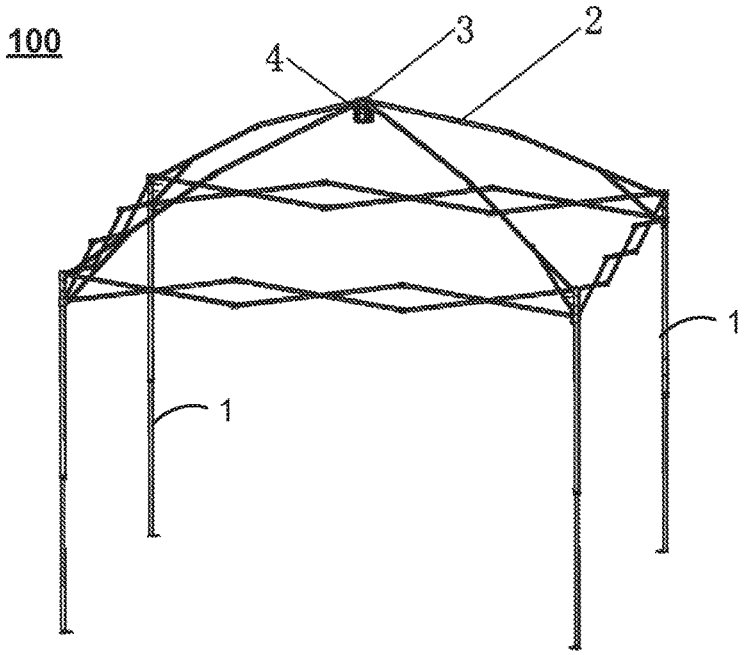
FIG. 1 is a schematic view illustrating a tent frame in an unfolded state in accordance with exemplary embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of tent frames with illumination, and tents including the tent frames with illumination and tent cloths supported by the tent frames with illumination. In the interest of clarity, tent cloths are not shown in the figures. Tents and tent frames of the present invention can be of various sizes and shapes, including but not limited to gazebos, domes, shelters and other types of tents. A tent frame can include various number of supporting poles such as upper and/or lower supporting poles. Generally, a tent frame of the present invention includes a plurality of upper supporting poles pivotally connected to each other, in which one or more of the upper supporting poles are configured with illumination sources. The illumination sources are electrically connected to, and thus powered by, a battery set, an external power source, or a combination of the battery set and the external power source through a control box. In some cases, the battery set is integrated with the control box. In some cases, the battery set is housed in a battery box removably coupled with the control box. The tent frames and the tents of the present invention are compact, easy to setup, and convenient to use.

Referring now to FIG. 1, there depicts a tent frame of the present invention in accordance with some exemplary embodiments. The tent frame includes a plurality of upper supporting poles such as four upper supporting poles 2 in the illustrated embodiment. The plurality of upper supporting poles is pivotally connected to each other by a connector such as first connector 3. The tent frame also includes a control box such as control box 4 disposed below the first connector when the tent frame is unfolded. Among the plurality of upper supporting poles 2, one or more upper supporting poles are configured with illumination. In an embodiment, each upper supporting pole is configured with illumination. As used herein, a supporting pole with illumination is referred to as an illumination supporting pole.

Figure 2:
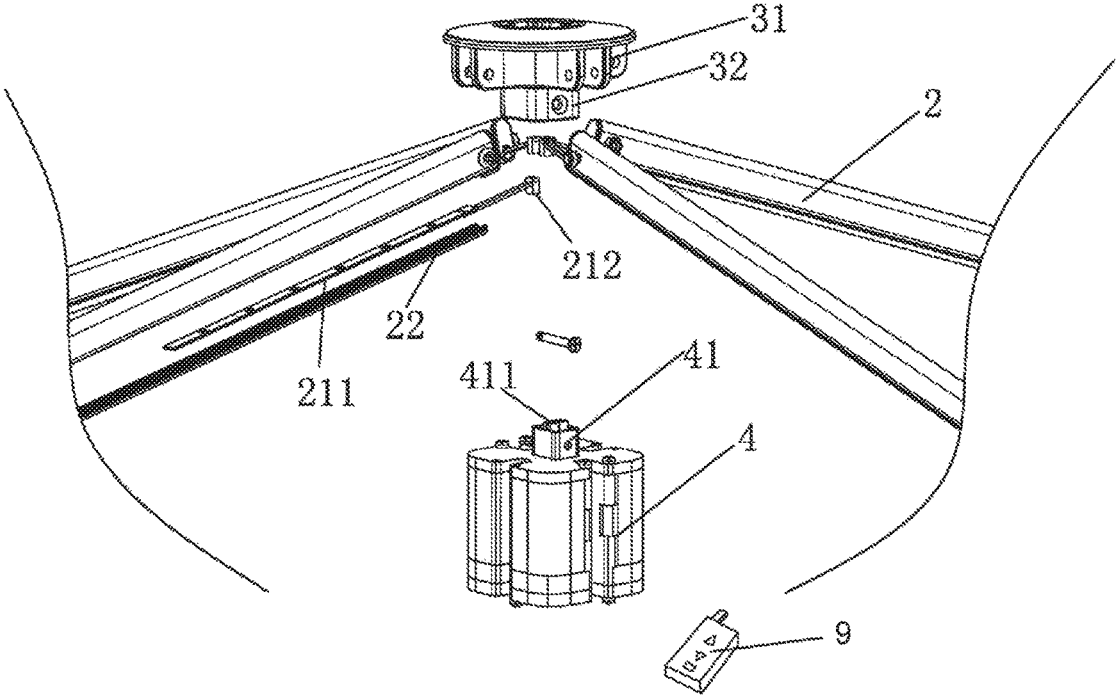
FIG. 2 is a partially enlarged and partially disassembled view illustrating some components of the tent frame of FIG. 1.
Figure 3:
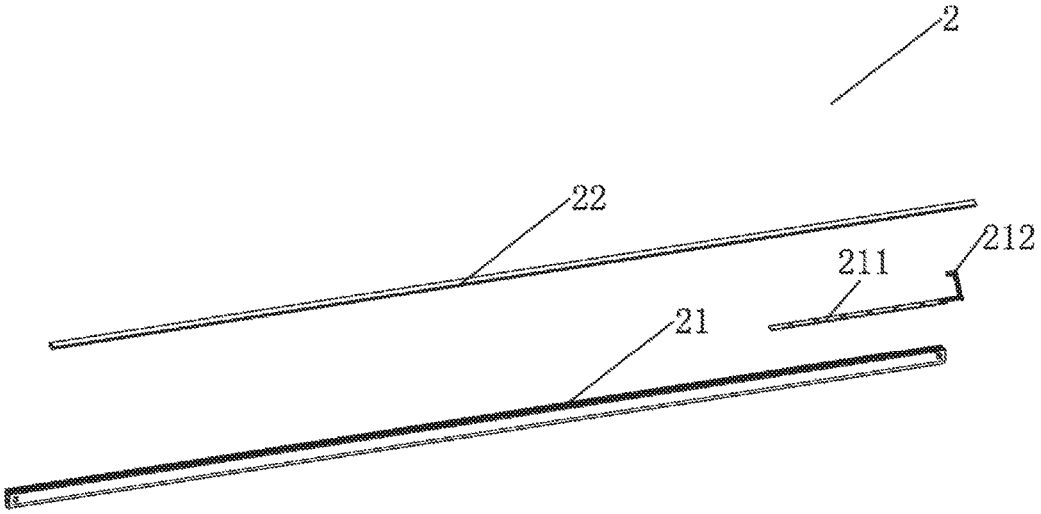
FIG. 3 is a disassembled view illustrating an illumination pole in accordance with exemplary embodiments of the present invention.

FIGS. 2 and 3 illustrate illumination supporting pole 2 in accordance with some exemplary embodiments. As shown, an illumination supporting pole includes an illumination groove such as illumination groove 21 and an illumination source such as illumination source 211 disposed in the illumination groove. Preferably, illumination groove 21 is elongated along a longitudinal direction of the illumination supporting pole, and illumination source 211 is an elongated illumination source including but not limited to lighting strips or lighting bands. In some embodiments, illumination groove 21 is formed at a lower side of the illumination supporting pole when the tent frame is unfolded, so that the illumination source faces the interior of the tent when the tent is unfolded. In some embodiments, the illumination source is an LED lighting strip.

In some embodiments, illumination supporting pole 2 further includes a translucent cover such as translucent cover 22. As used herein, the term "translucent cover" refers to a cover made of a material that is transparent to at least a portion or a certain wavelength range of the light emitted from the illumination source. It can be but does not necessarily need to be completely transparent to the entire light emitted from the illumination source. Translucent cover 22 and illumination groove 21 are coupled to each other, for instance, though snap-fitting, press-fitting or any suitable methods, and enclose illumination source 211 within. In some embodiments, illumination source 211 of each illumination supporting pole includes an interface such as first interface 212 at an end adjacent first connector 3. First interface 212 of illumination source 211 is placed outside of illumination groove 21 and/or translucent cover 22 for connecting with control box 4, which is disposed below first connector 3 when the tent frame is unfolded.

Figure 4:
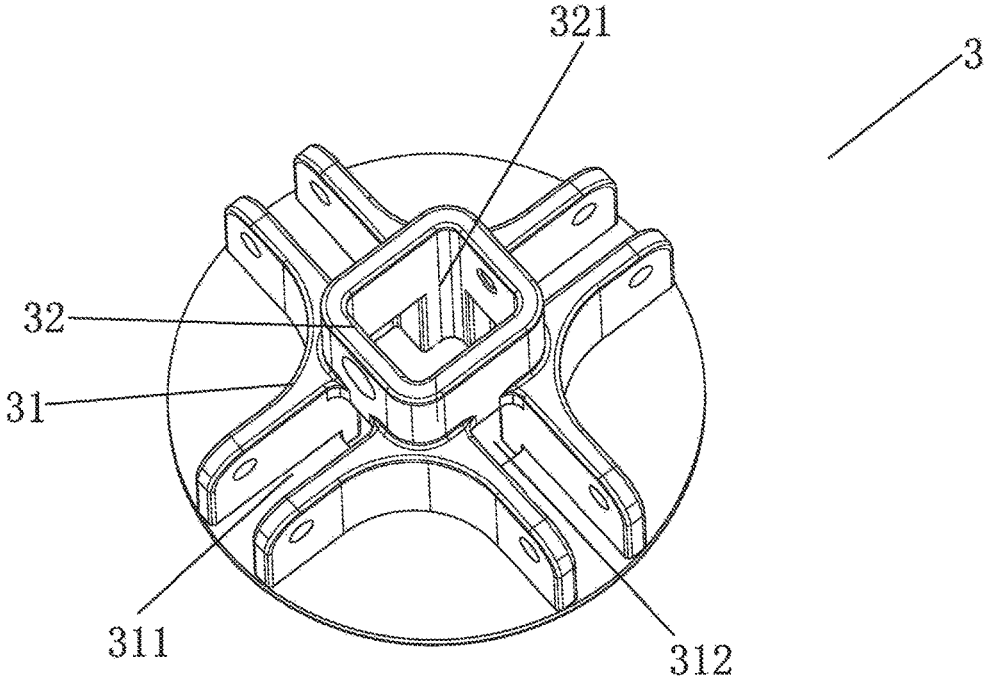
FIG. 4 is a perspective view illustrating a connector of a tent frame in accordance with exemplary embodiments of the present invention.
Figure 5:
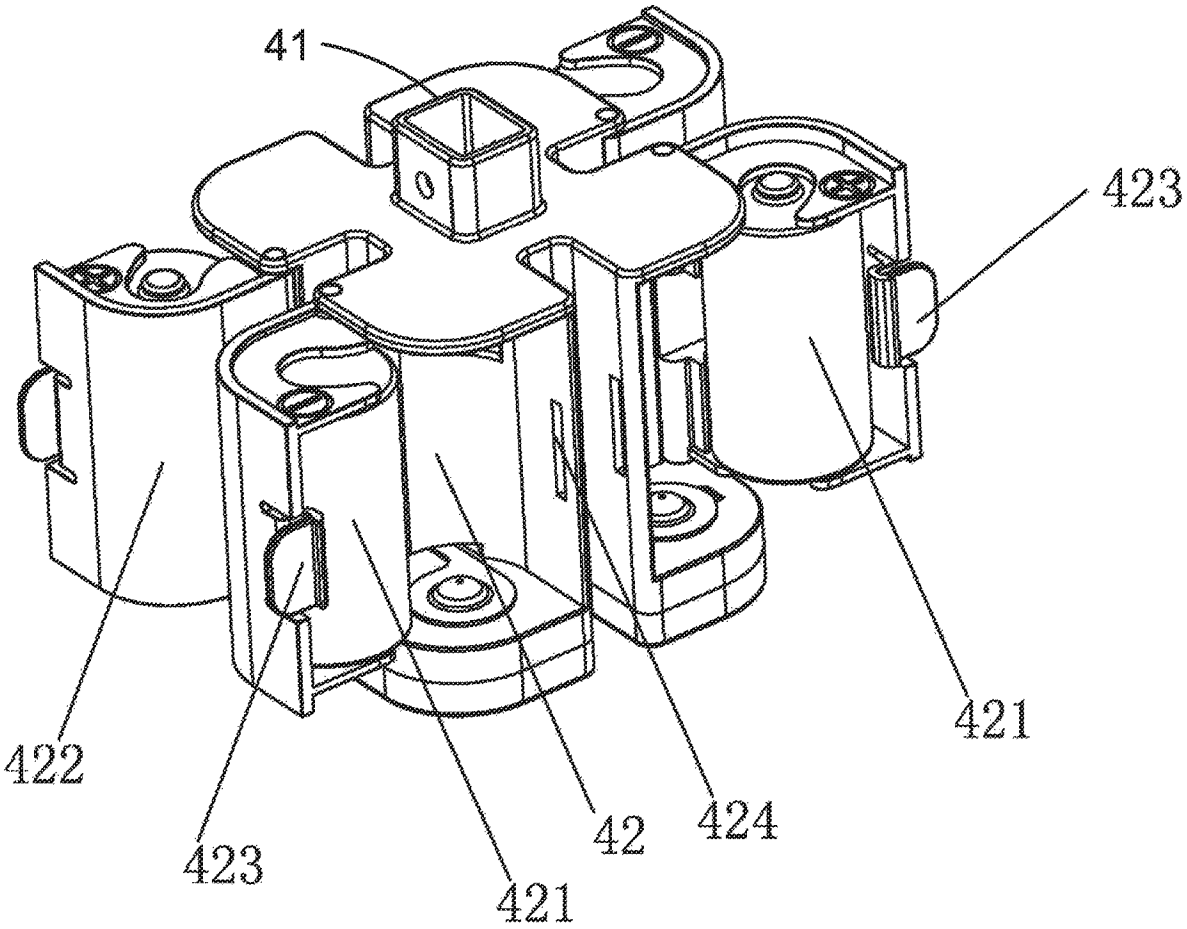
FIG. 5 is a perspective view illustrating some components of a control box in accordance with exemplary embodiments of the present invention.

FIGS. 2 and 4 illustrate first connector 3 in accordance with some exemplary embodiments. As shown, in some embodiments, first connector 3 includes first portion 31, and second portion 32 disposed below first portion 31 when the tent frame is unfolded. First portion 31 includes a plurality of connecting slots for pivotally connecting the plurality of upper supporting poles 2. By way of example, FIG. 4 shows four connecting slots 311 extending radially outward and forming a cross shape. Each slot 311 includes two side walls for pivotally connecting one upper supporting pole 2, for instance, by a fastener through the holes formed on the side walls of the slot and at one end of the upper supporting pole. The side walls of the slot also serve as guides guiding the rotation of the upper supporting pole.

In some embodiments, second portion 32 of first connector 3 includes a compartment such as receiving compartment 321 for connecting with control box 4. In some embodiments, the wall of the receiving compartment is formed with a plurality of holes such as holes 312, through which, slots 311 are connected to receiving compartment 321.

Referring to FIGS. 1, 2, 5 and 6, control box 4 is coupled to first connector 3 at the lower side of the first connector. In some embodiments, control box 4 includes a compartment such as protrusion compartment 41 for coupling with receiving compartment 321 of first connector 3. In the illustrated embodiment, protrusion compartment 41 is formed at an upper side of the control box. Protrusion compartment 41 of control box 4 and receiving compartment 321 of first connector 3 can be coupled to each other by any suitable means including but not limited to snap-fitting, press-fitting, screws, nuts and bolts. For example, they can be fastened using nuts and bolts through the holes formed on the walls of the protrusion compartment and the receiving compartment.

Figure 6:
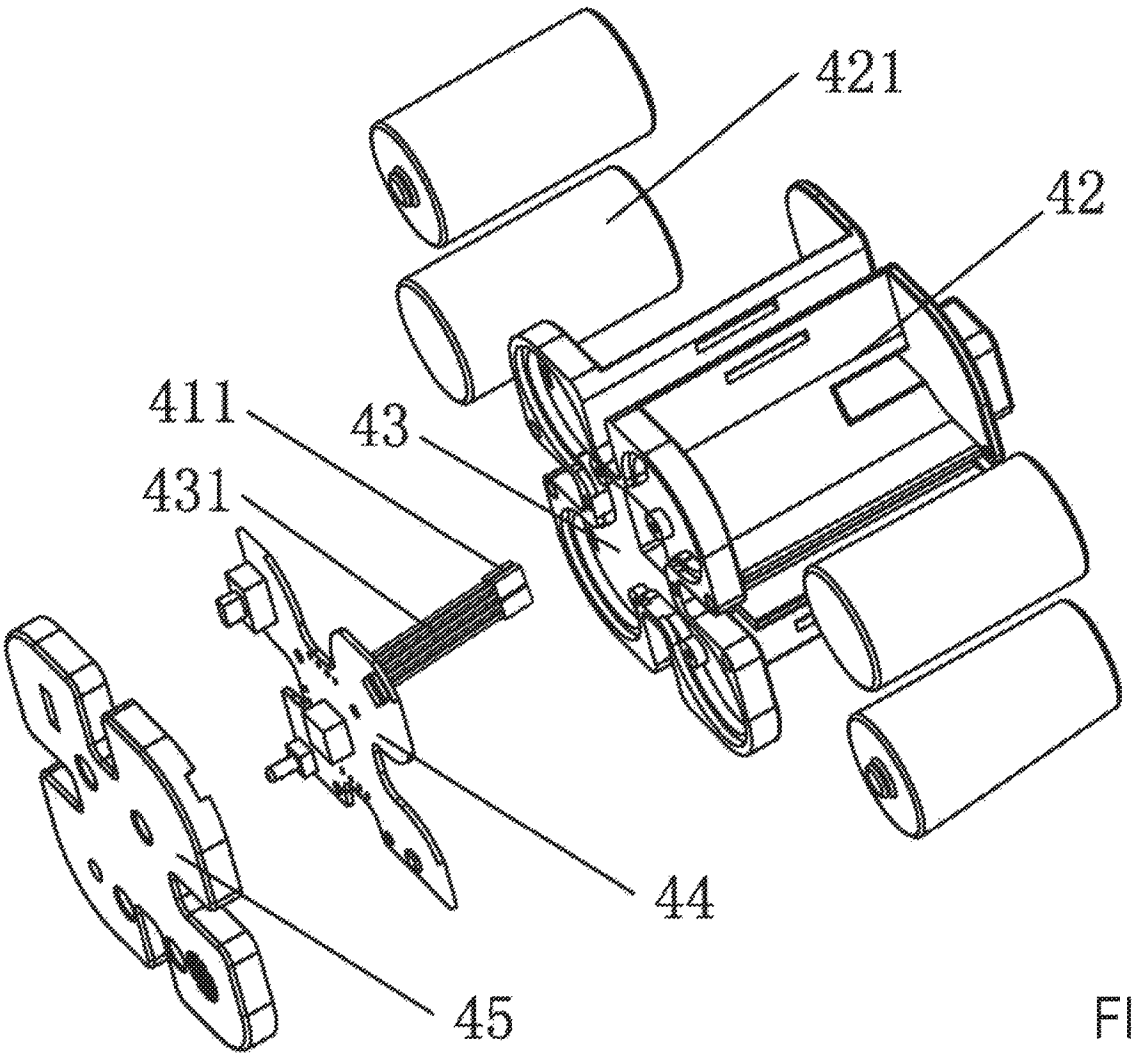
FIG. 6 is a perspective and partially disassembled view illustrating some components of the control box of FIG. 5.

Control box 4 is configured to control the operation of the illumination. For instance, control box 4 can be used to turn on/off the illumination, adjust the brightness/intensity/color of the illumination, or the like. In various embodiments, control box 4 includes a printed circuit board (PCB) configured to be electrically connected to a battery set, an external power source, or a combination of the battery set and the external power source. By way of example, FIGS. 2 and 6 illustrates control box 4 including control PCB board 44 electrically connected to a battery set having a plurality of batteries 421. In some embodiments, control box 4 includes a plate or cover such as mounting plate 45 for mounting control PCB board 44. In an embodiment, mounting plate 45 also severs as a bottom cover of the control box.

In some embodiments, corresponding to illumination source 211 of each illumination supporting pole, the control box further includes a second interface such as second interface 411, preferably disposed at protrusion compartment 41 of control box 4 when assembled. First interface 212 of the illumination source of each illumination supporting pole is electrically connected to the corresponding second interface 411. Corresponding to illumination source 211 of each illumination supporting pole, the control box also includes an electrical line (e.g., wire, cord, cable, or the like) such as first electrical line 431 to connect control PCB board 44 with the second interface.

In some embodiments, control box 4 further includes a passage such as passage 43 connected to protrusion compartment 41 to allow the first electrical line pass through. In some embodiments, control box 4 further includes a plurality of battery compartments 42, each for housing a battery such as battery 421. The number of the battery compartments can be varied, and by way of example, four battery compartments are illustrated. Preferably, the passage is formed in the middle or middle portion of the control box, with the plurality of the battery compartments disposed circumferentially around the passage. In an embodiment, the passage is the space formed collectively by the plurality of the battery compartments.

In some embodiments, corresponding to each battery compartment 42, control box 4 includes a battery cover such as battery cover 422. In a preferred embodiment, battery cover 422 has a first side rotatably coupled with a corresponding battery compartment and a second side releasably coupled with the corresponding battery compartment. For instance, the first side of battery cover 422 can be hinged to the corresponding battery compartment. The second side of battery cover 422 can be coupled to the corresponding battery compartment through snap 423 formed at the second side of battery cover 422 and slot 424 formed at the corresponding battery compartment. As such, a battery can be held safely in the battery compartment when battery cover 422 is closed. To change the battery, simply uncouple snap 423 from slot 424 and rotate to open battery cover 422. The battery set housed in the control box is safe and does not require additional space.

Assembling the tent frame is simple. For example, first, connect the upper supporting poles 2 with first connector 3, and place, via hole 312, first interface 212 of illumination source 211 in receiving compartment 321 of first connector 3. Then, couple control box 4 with first connector 3. Afterwards, connect first interface 212 of illumination source 211 of each illumination supporting pole with its corresponding second interface 411 disposed at protrusion compartment 41 of control box 4.

Figure 7:
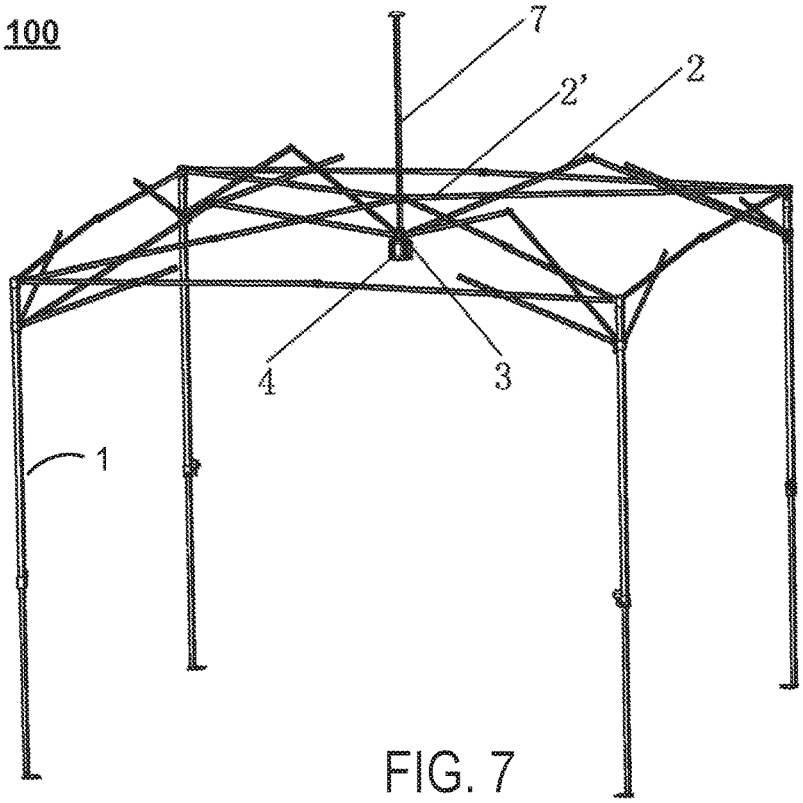
FIG. 7 is a schematic view illustrating a tent frame in an unfolded state in accordance with exemplary embodiments of the present invention.
Figure 8:
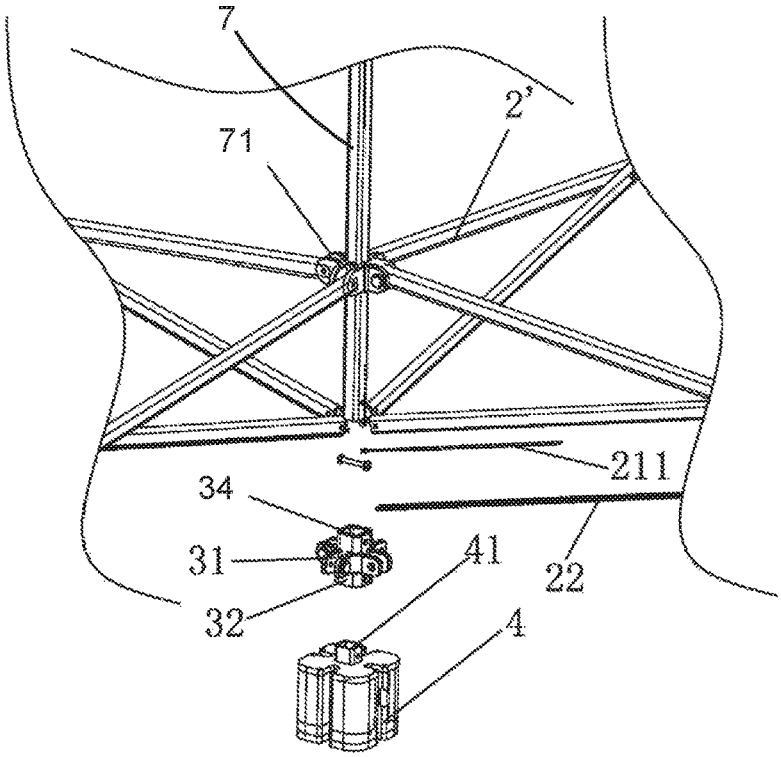
FIG. 8 is a partially enlarged and partially disassembled view illustrating some components of the tent frame of FIG. 7.
Figure 9:
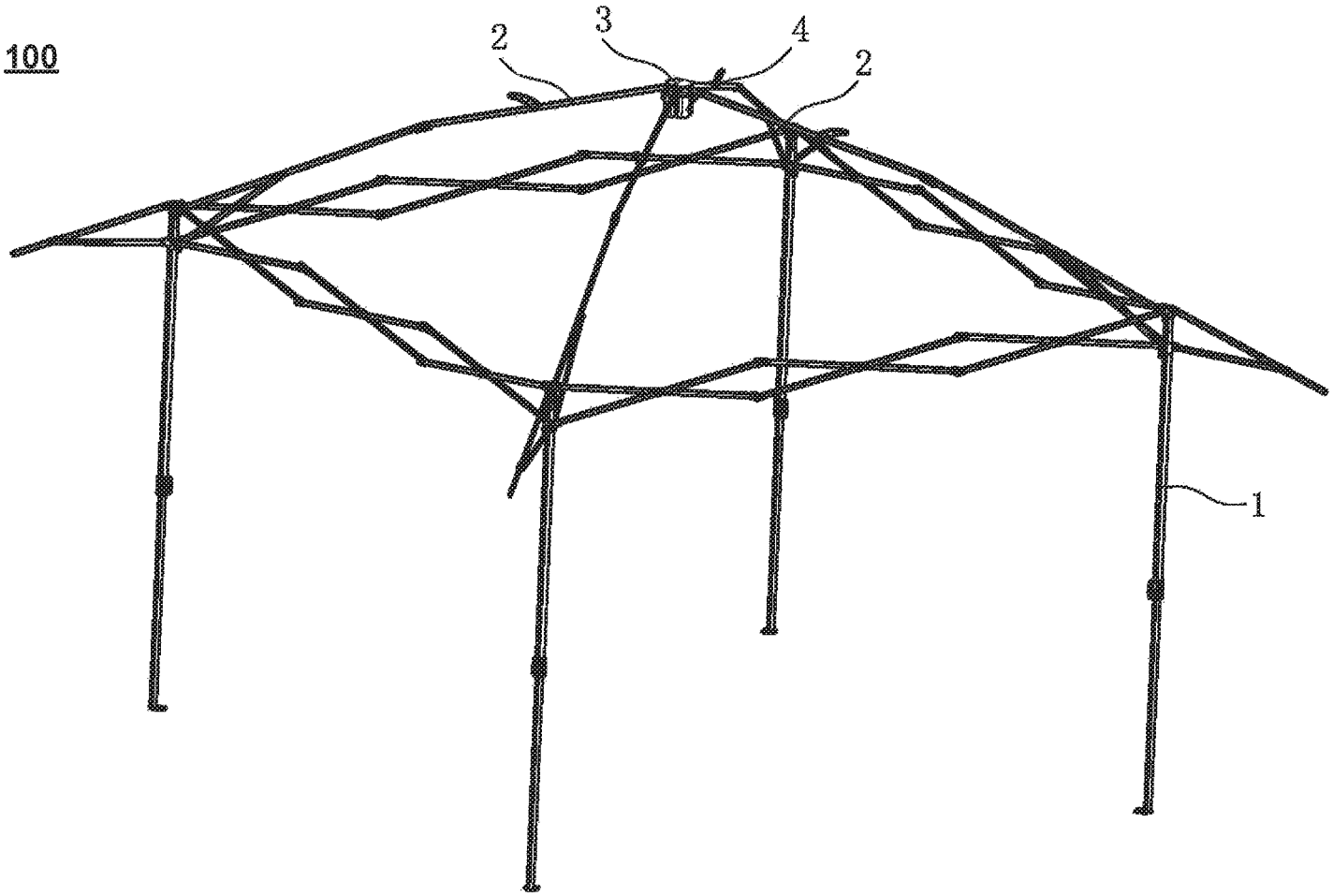
FIG. 9 is a schematic view illustrating a tent frame in an unfolded state in accordance with exemplary embodiments of the present invention.
Figure 10:
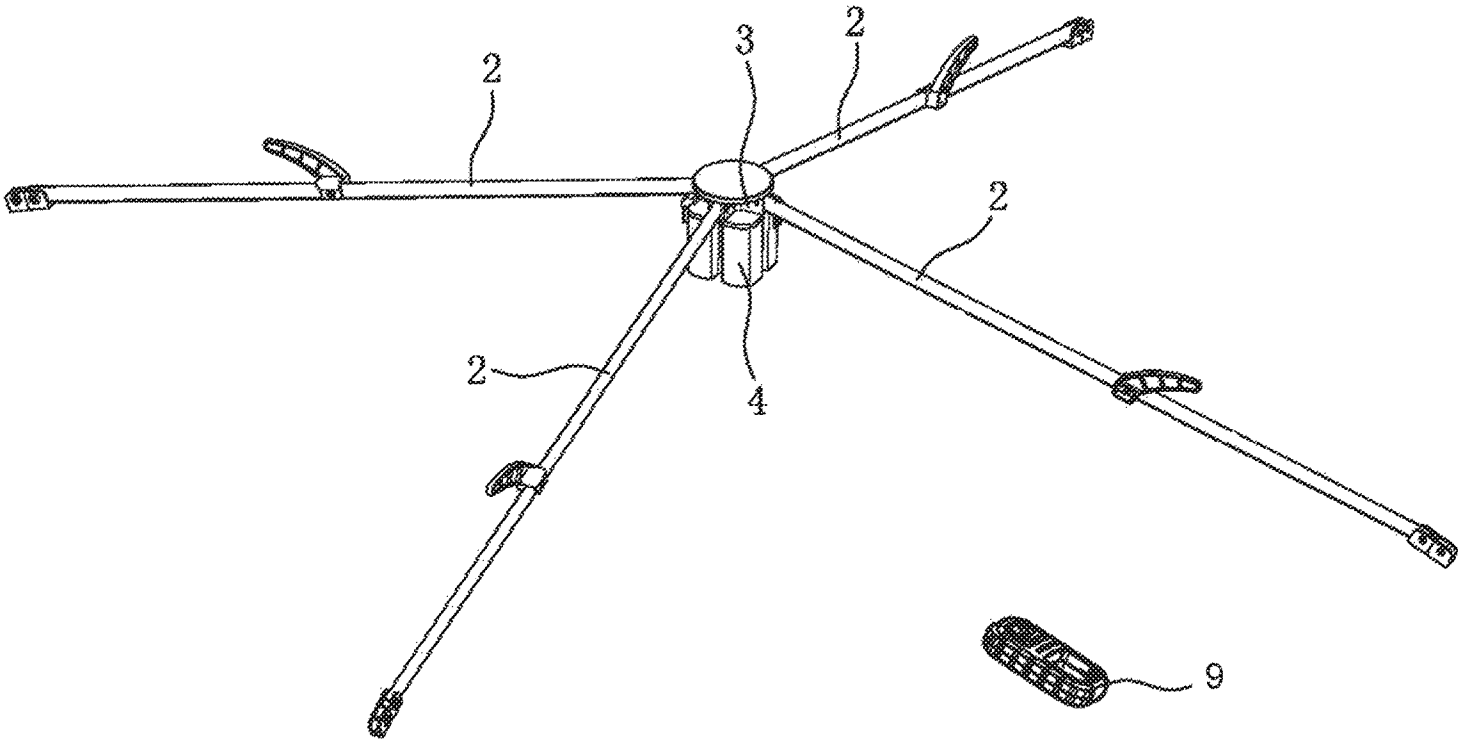
FIG. 10 is a partially enlarged view illustrating some components of the tent frame of FIG. 9.
Figure 11:
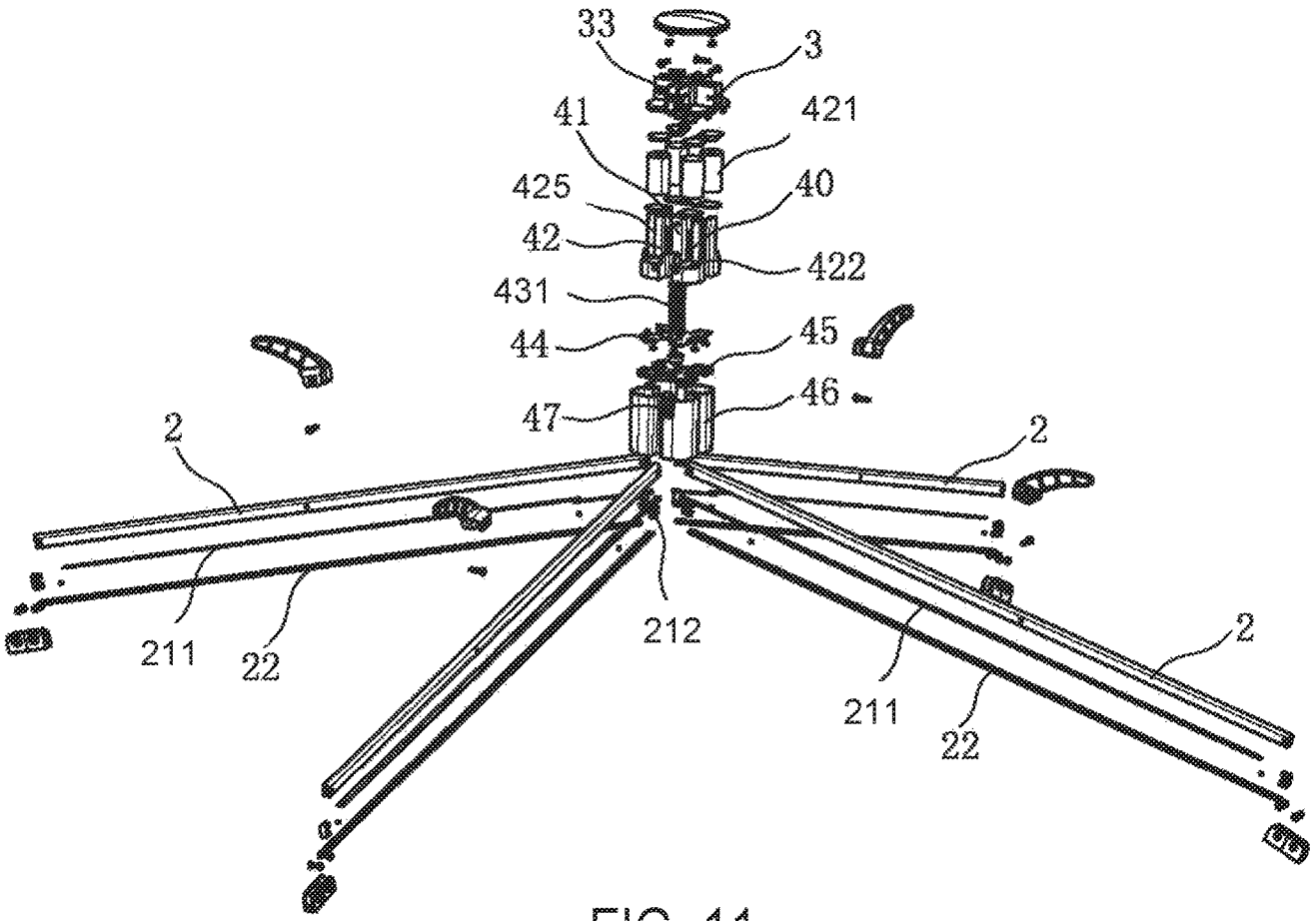
FIG. 11 is a partially disassembled view illustrating some components of the tent frame of FIG. 9.
Figure 12:
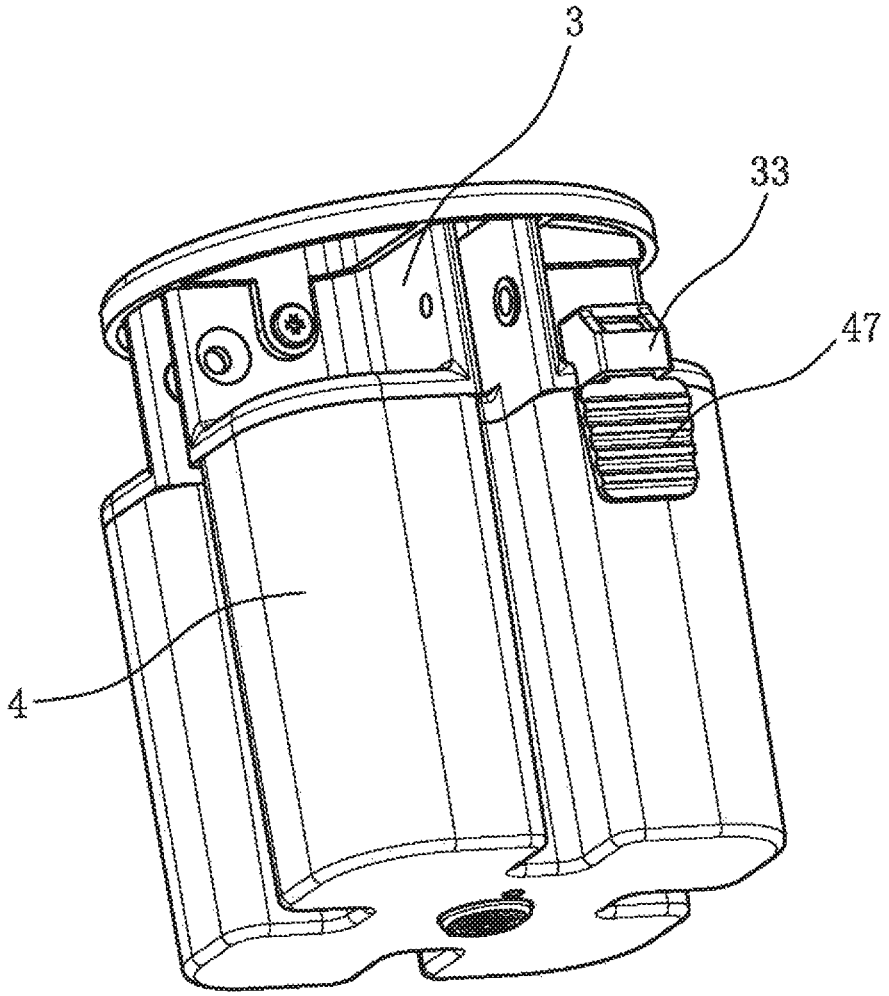
FIG. 12 is a perspective view illustrating a connector and a control box in accordance with exemplary embodiments of the present invention.
Figure 13:
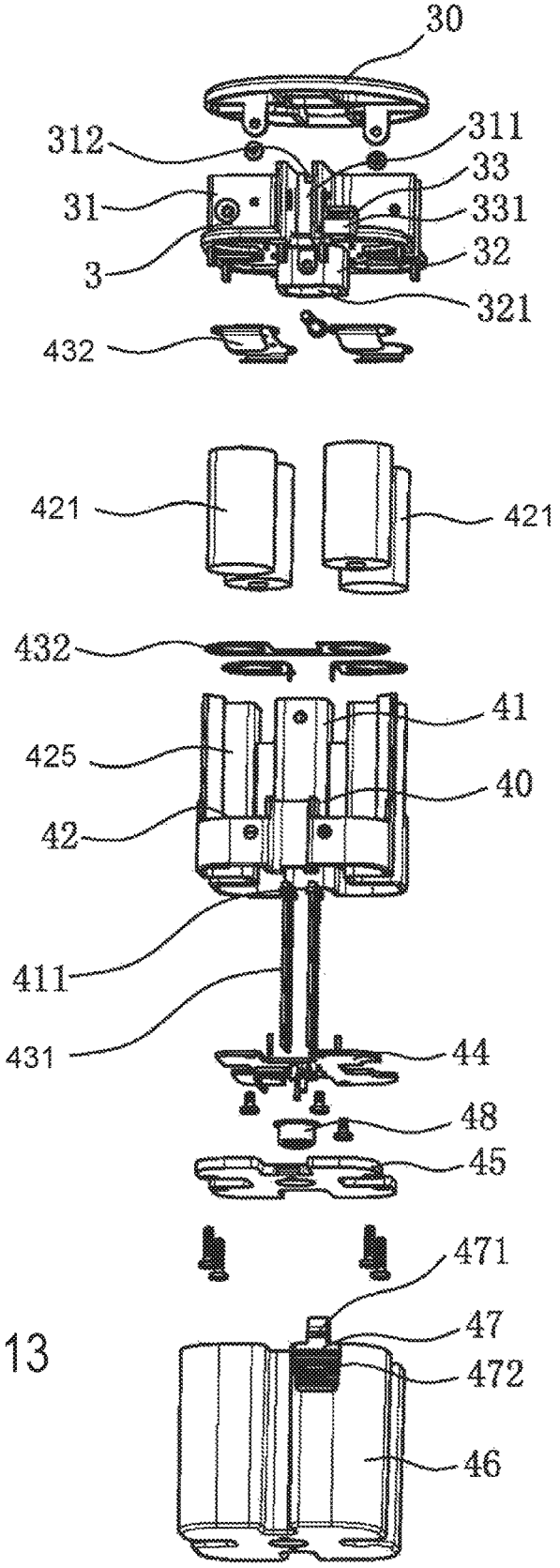
FIG. 13 is a perspective and partially disassembled view illustrating the connector and the control box of FIG. 12.

In some embodiments, the tent frame further includes one or more additional, optional or modified components. For example, FIG. 1 illustrates the tent frame including lower supporting poles 1 connected to the upper supporting poles, and remote control 9 wirelessly connected to the control box to control the operation of the illumination source of each illumination supporting pole. FIGS. 7 and 8 illustrate an alternative tent frame including central pole 7, second connector 71 disposed at the central pole, and a plurality of additional upper supporting poles 2' connected to second connector 71. To couple the central pole, first connector includes first portion 31, second portions, 32, and additional third portion 34. FIG. 13 illustrates a tent frame includes top cover 30 disposed on top of first connector 3. In some cases, top cover 30 serves as a cover to the first connector or to the control box or to both.

Referring now to FIGS. 9-13, there depicts a tent frame with alternative or modified first connector and control box in accordance with some exemplary embodiments. As shown, control box 4 in such embodiments does not include an individual battery cover for each battery compartment. Instead, it includes control inner part 40 and control outer casing 46. Control inner part 40 includes protrusion compartment 41 and a plurality of battery compartments 42 disposed circumferentially around the protrusion compartment for housing batteries 421. Control outer casing 46 covers the control inner part and batteries housed in the battery compartments. As such, two or more or all of the batteries can be replaced at once by simply removing the control outer casing or taking the control inner part out of the control outer casing.

In some embodiments, battery spring pieces 432 are disposed above and below batteries 421. The above battery spring pieces 432 are disposed below first portion 31 of first connector 3, and the below battery spring pieces 432 are disposed at the bottom of the battery compartments 42. In some embodiments, control inner part 40 also includes plates 425 disposed outward of the protrusion compartment to separate the battery compartments from each other. In the embodiment with four battery compartments, two plates 425 are disposed, with one on each side of the protrusion compartment. In an embodiment, control inner part 40 further includes plates extending from plates 425 to assist in holding the batteries.

In some embodiments, control outer casing 46 is configured to be removably coupled with first connector 3. For example, first connector 3 is configured to include sliding groove 33, and stopper 331 disposed at an outer side of the sliding groove. Corresponding to sliding groove 33 and stopper 331, control outer casing 46 includes positioning button 47 with positioning protrusion 471. Positioning button 47 is configured to be slidable along the sliding groove of the first connector. Preferably, positioning button 47 is disposed or formed at the upper outer side of control outer casing 46, and positioning protrusion 471 is formed at the upper end of the positioning button. To couple control outer casing 46 with first connector 3, simple push the control outer casing upward until positioning protrusion 471 of positioning button 47 engages with stopper 331 of first connector 3. Stopper 331 holds positioning button 47, and thus holds control outer casing 46, in place. To uncouple control outer casing 46 from first connector 3, simply press positioning protrusion 471 to release positioning protrusion 471 from stopper 331, and push the control outer casing downward.

In some embodiments, positioning button 47 further includes a pushing portion such as pushing portion 472 formed below the positioning protrusion. Preferably, pushing portion 472 is formed with ribs, grooves, bumps or the like to assist in pushing positioning button 47 along sliding groove 33, and thus assisting in coupling/uncoupling of the control box with the first connector.

In some embodiments, control box 4 further includes control button 48 to control the operation of the illumination source of each illumination supporting pole. In the illustrated embodiment, control button 48 is placed under control PCB board 44. Control button 48 is exposed to or is accessible from the outside of control outer casing 46, for example, through the holes formed at mounting plate 45 and/or at control outer casing 46. Control button 48 can be used in combination with remote control 9, or used alone (e.g., in embodiments without remote control 9 or when remote control 9 is lost).

Turning now to FIGS. 14-17, there depicts a tent frame of the present invention in accordance with some exemplary embodiments. As shown, the tent frame includes a plurality of lower supporting poles 1 and a plurality of upper supporting poles 2. The plurality of upper supporting poles 2 is pivotally connected to first connector 3. One or more upper supporting poles 2 are configured with illumination, and the operation of the illumination is controlled by control box 4 disposed below first connector 3 when the tent frame is unfolded. In the illustrated embodiments, control box 4 includes control PCB board 44, and a casing such as control casing 49 coupled to first connector 3. First PCB board 44 is electrically connected with illumination source 211 of each illumination supporting pole, for instance, by first electrical lines 431. In some embodiments, control PCB board 44 is mounted on mounting plate 45, which in some cases serves as the bottom of the control box. In some embodiments, control box 4 further includes one or more seals, for example, seals 491, 492, and 493. Seal 491 is disposed between mounting plate 45 and control PCB board 44, seal 492 is disposed above control casing 49, and seal 493 is disposed above seal 492 and under top cover 30.

Figure 14:
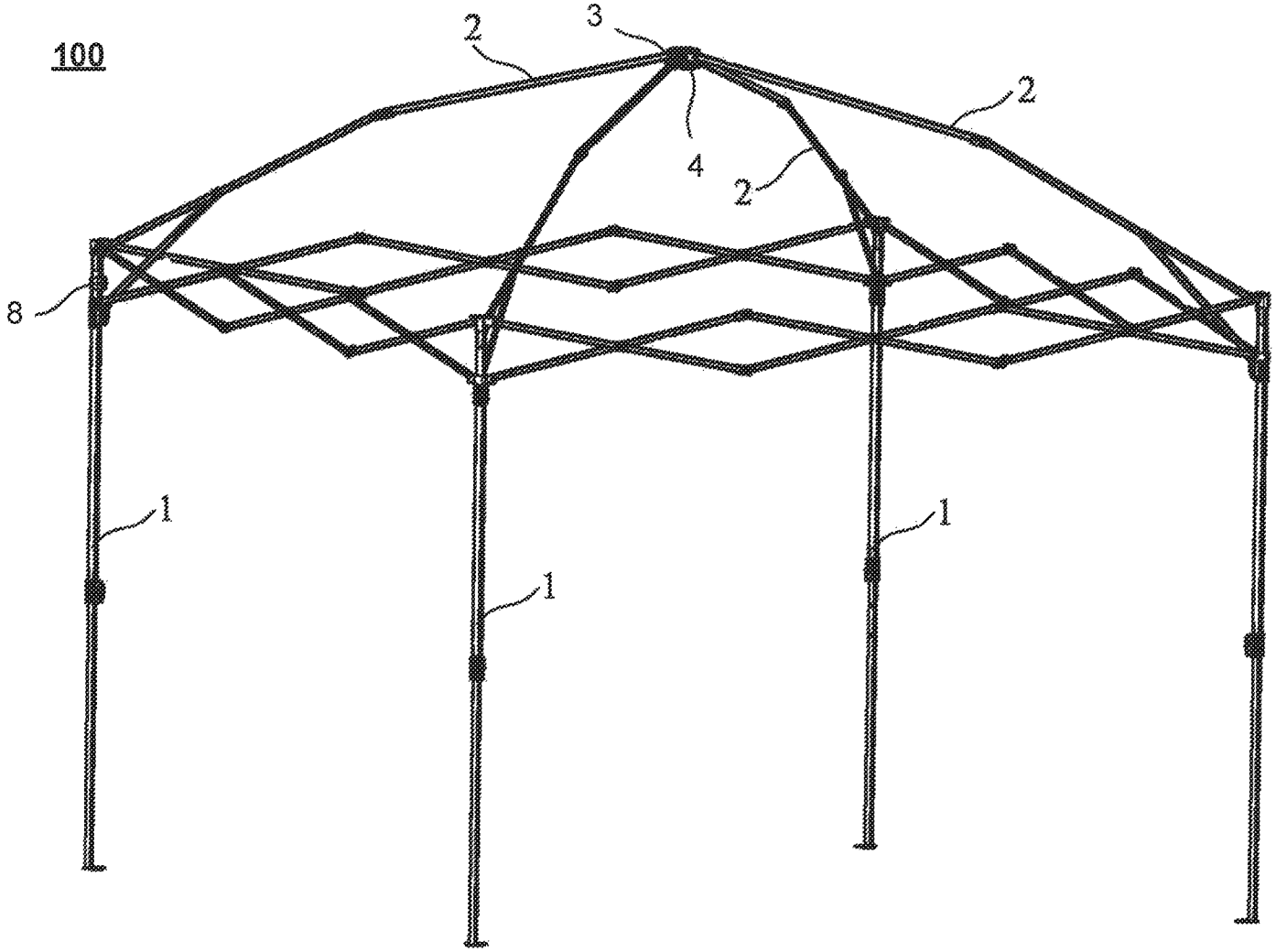
FIG. 14 is a schematic view illustrating a tent frame in an unfolded state in accordance with exemplary embodiments of the present invention.
Figure 15:
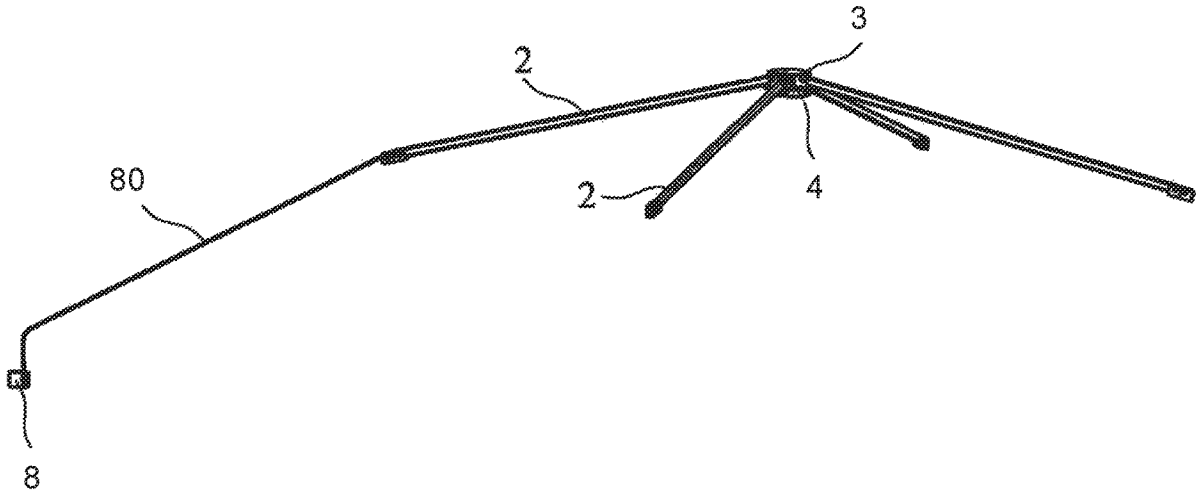
FIG. 15 is a schematic view illustrating some components of the tent frame of FIG. 14.
Figure 16A:
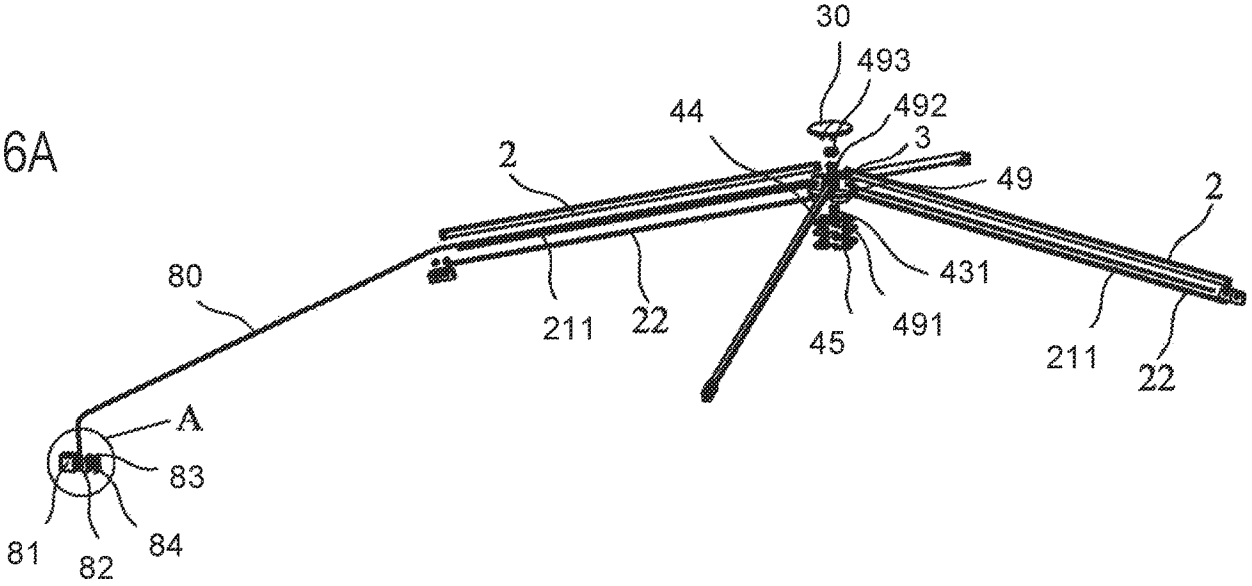
FIG. 16A is a schematic and partially disassembled view illustrating some components of the tent frame of FIG. 14.
Figure 16B:
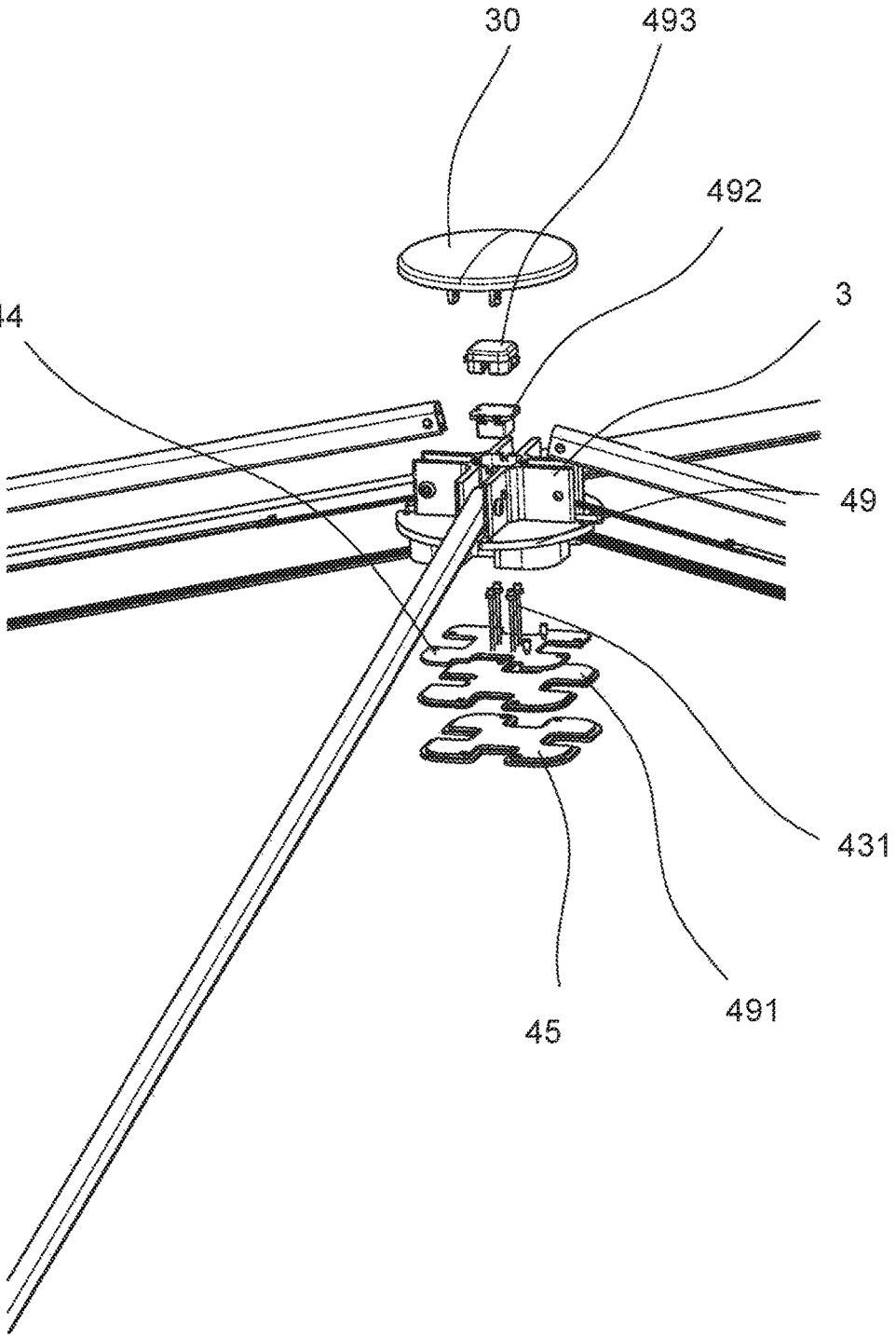
FIG. 16B is a partially enlarged view of FIG. 16A.

In embodiments of FIGS. 14-17, control box 4 is not incorporated or coupled with a battery set. Instead, it is electrically coupled to an external power interface such as external power interface 8 configured for connecting with an external power source. External power interface 8 can be mounted at a lower or upper supporting pole. By way of example, FIG. 14 shows external power interface 8 mounted at a lower supporting pole. In some embodiments, external power interface 8 includes an interface outer casing such as interface outer casing 81 configured to be mounted at a lower or upper supporting pole.

In some embodiments, external power interface 8 includes external power interface PCB board 82 disposed in the interface outer casing, and second electrical line 80 (e.g., wire, cord, cable, or the like) electrically connecting external power interface PCB board 82 with control PCB board 44 of control box 4. Thus, once an external power source is connected to or plugged in external power interface 8, the external power source can provide power supply to control PCB board 44 of the control box, and/or power supply to illumination source 211 through control PCB board 44 of the control box.

Figure 17:
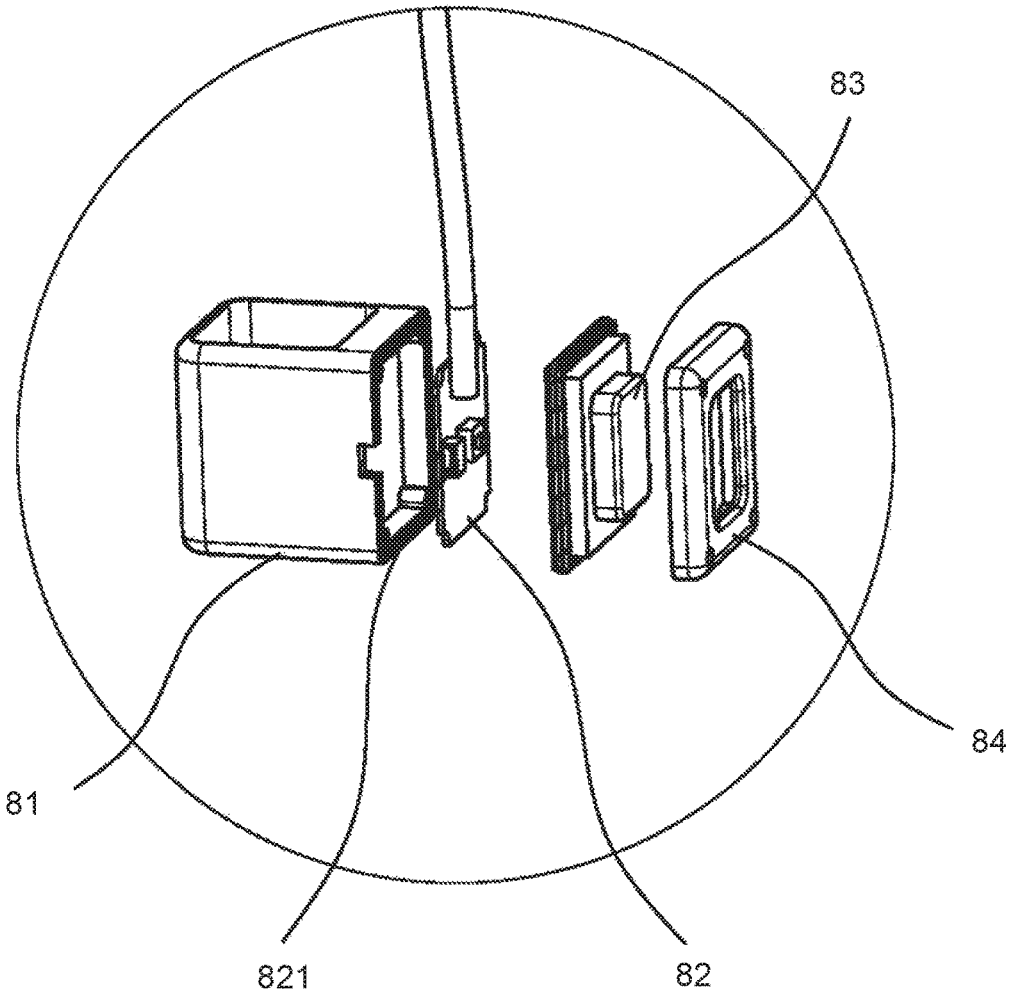
FIG. 17 is a partially enlarged and partially disassembled view illustrating an external power interface in accordance with exemplary embodiments of the present invention.
Figure 18:
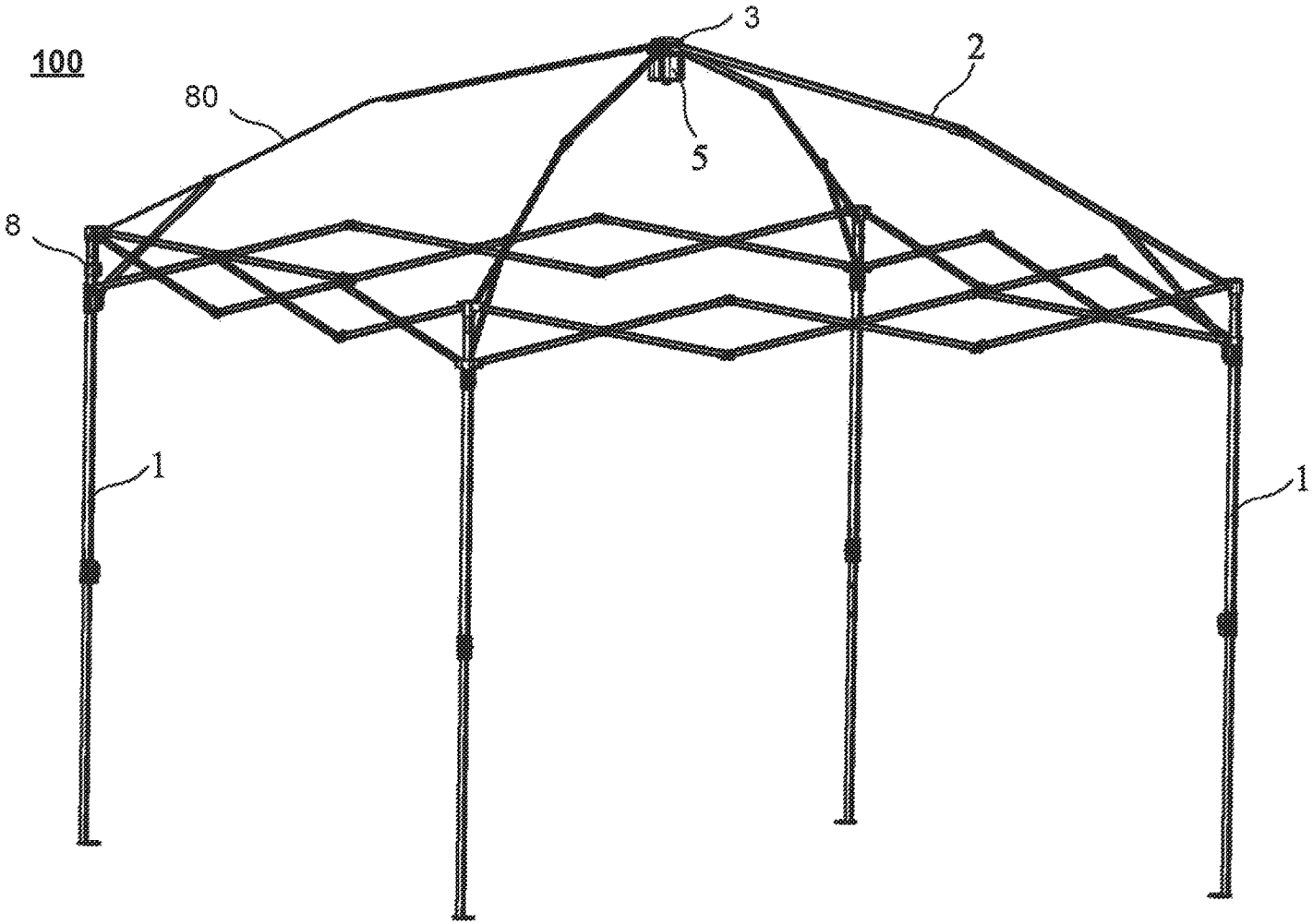
FIG. 18 is a schematic view illustrating a tent frame in an unfolded state in accordance with exemplary embodiments of the present invention.
Figure 19:
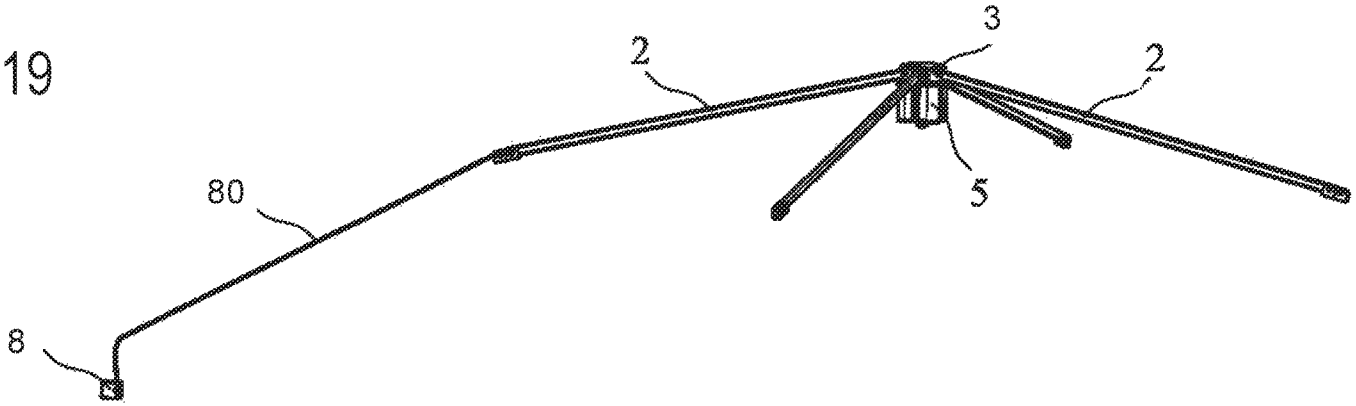
FIG. 19 is a schematic view illustrating some components of the tent frame of FIG. 18.
Figure 20:
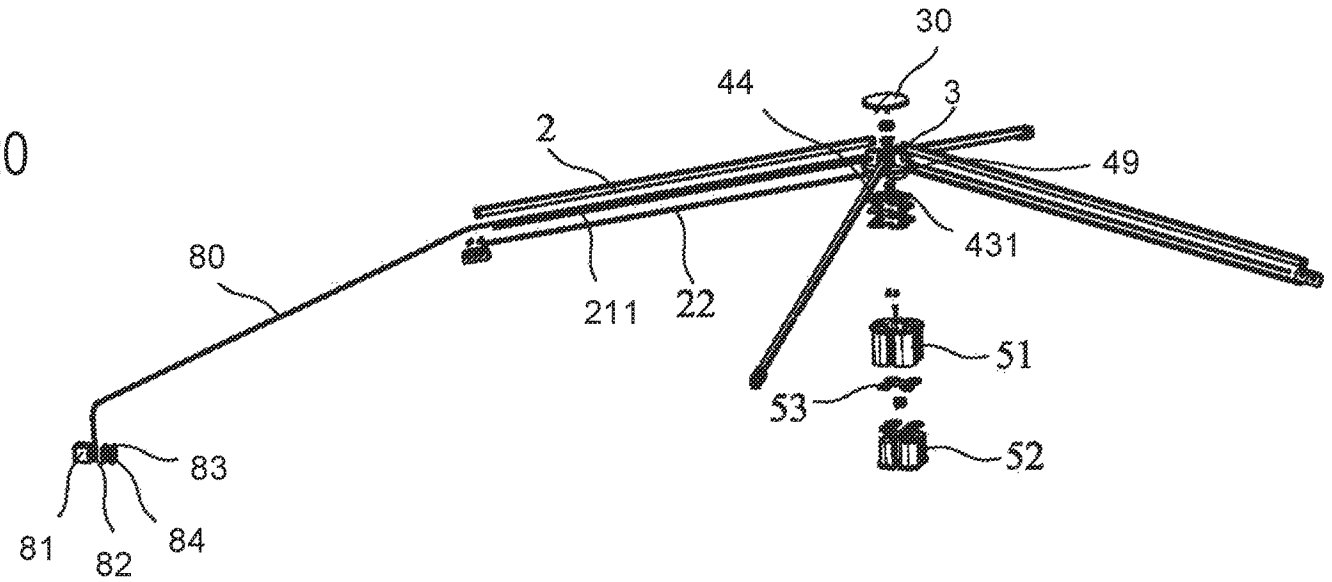
FIG. 20 is a schematic and partially disassembled view illustrating some components of the tent frame of FIG. 18.
Figure 21A:
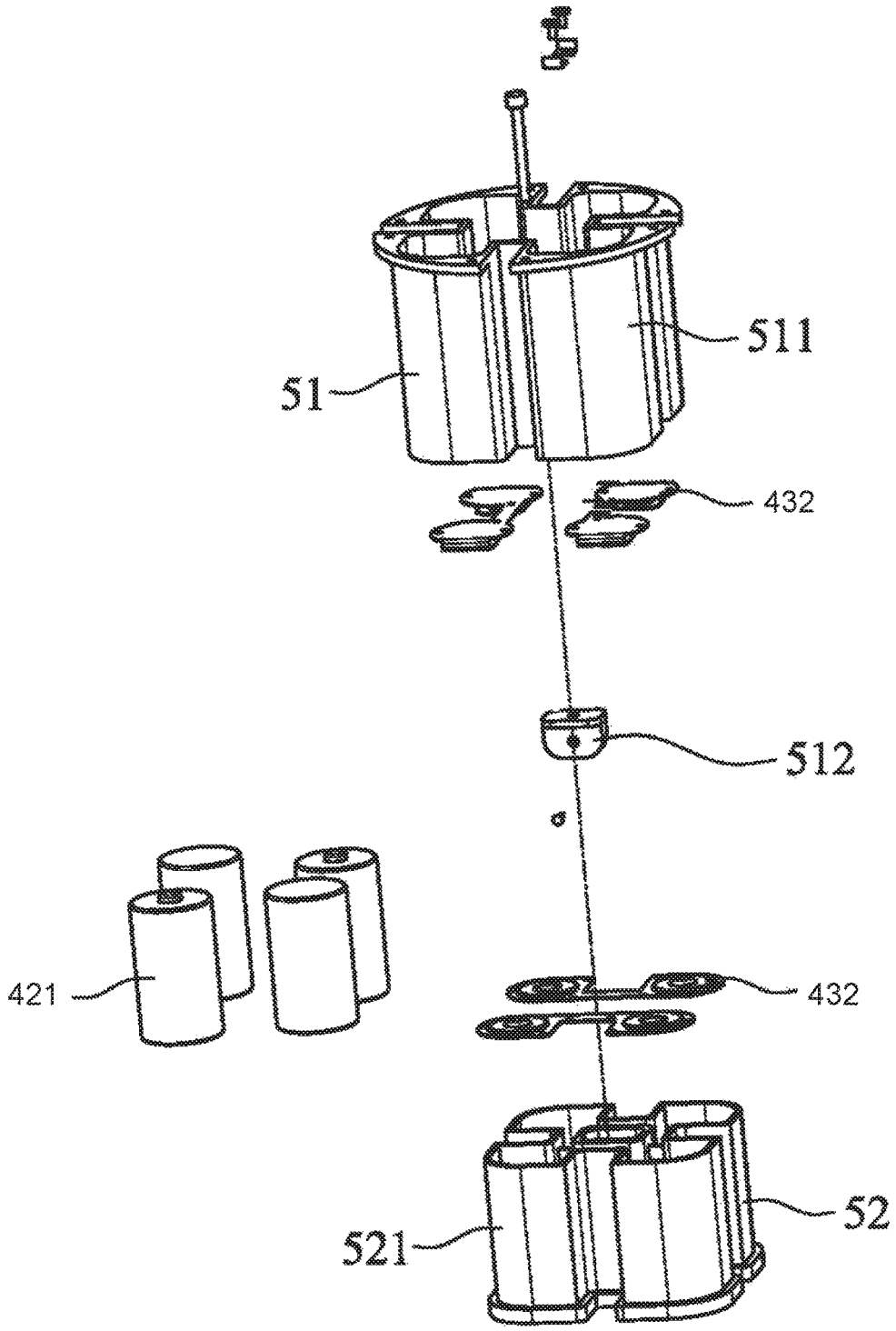
FIGS. 21A, 21B, 21C, 21D, 21E and 21F are views illustrating a battery box in accordance with exemplary embodiments of the present invention.
Figure 21B:
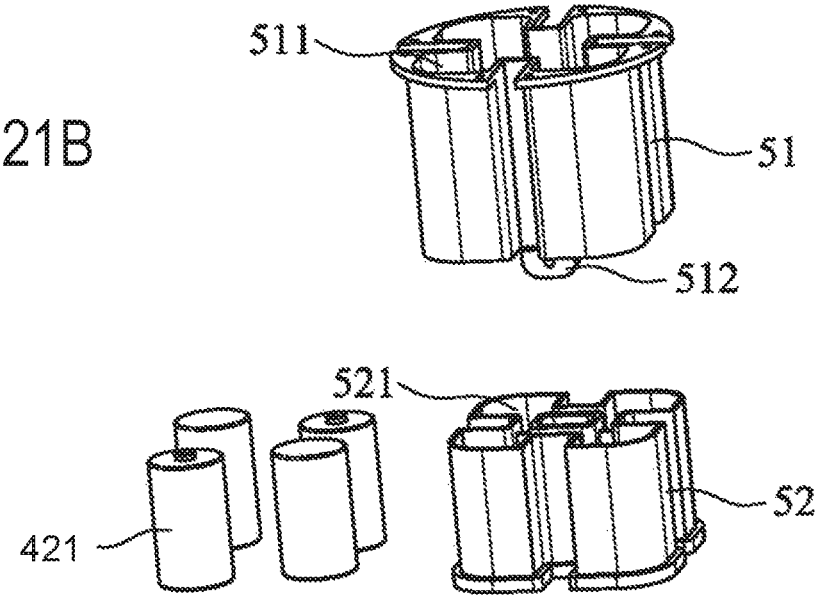
Figure 21C:
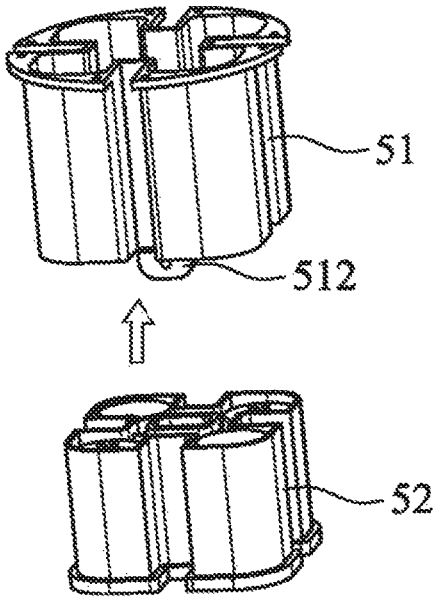
Figure 21D:
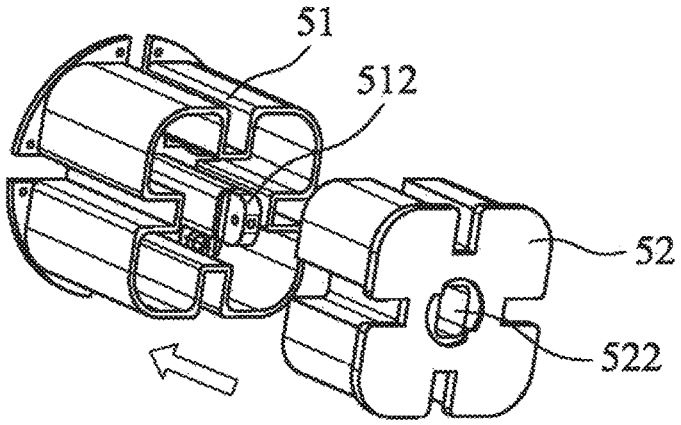
Figure 21E:
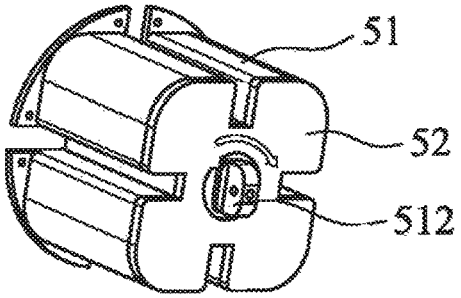
Figure 21F:
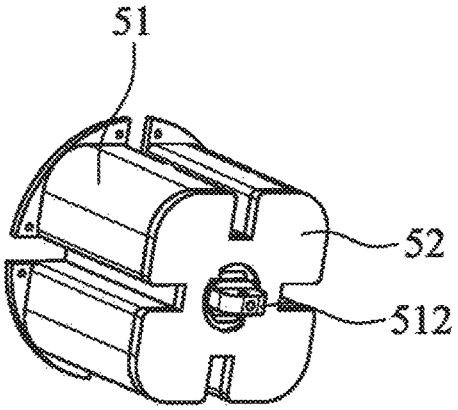

In a preferred embodiment, external power interface PCB board 82 includes an interface accessible from outside of the interface outer casing for connecting with an external power source. The external power source can be any suitable power sources, stationed or mobile, including but not limited to mobile power packs and solar cells. For instance, FIG. 17 illustrates external power interface PCB board 82 including USB interface 821 (e.g., USB, miniUSB, microUSB, or the like) accessible from outside of interface outer casing 81 (e.g., through the slot formed at the interface outer casing) for connecting with a mobile power pack, a solar cell or the like.

In some embodiments, external power interface PCB board 82 includes switch 822. Corresponding to switch 822, external power interface 8 further includes interface push button 83 disposed on a side of the external power interface PCB board to control the external power interface PCB board, the power supply to the control box, and/or the operation (e.g., on/off or brightness) the illumination of each illumination supporting pole. In an embodiment, external power interface 8 additionally or optionally includes interface cover 84 disposed on an outer side of the interface push button and coupled with the interface outer casing.

In some embodiments, a tent frame of the present invention includes both an external power source interface and a battery set. The external power source interface and the battery set can work alone, or as an addition or option to the other. The battery set can be integrated into the control box such as those described herein and illustrated in FIGS. 5-6 and 12-13, or housed in a separate battery box configured to be coupled with the control box as illustrated in FIGS. 18-21F.

By way of example, FIGS. 18-21F illustrate a tent frame of the present invention including external power interface 8 and a battery set housed in a separate battery box such as battery box 5. Battery box 5 is coupled with control box 4 from below. In some embodiments, battery box 5 includes battery outer casing 51 fastened to control casing 49 of control box 4 and battery inner part 52 removably coupled with battery outer casing 51. In the illustrated embodiments, battery outer casing 51 includes rotatable knob 512, preferably disposed at the bottom central portion of the battery outer casing. Corresponding to rotatable knob 512, battery inner part 52 includes opening 522 to allow rotatable knob 512 pass through. Thus, battery inner part 52 can be inserted into and removed from battery outer casing 51 from below, making replacement of batteries easy and convenient. To secure battery inner part 52 in battery outer casing 51, turn rotatable knob 512 to abut and hold the bottom of the battery inner part. In some embodiments, battery outer casing 51 includes compartments 511 each shaped in accordance with battery compartment 521.

Figure 22:
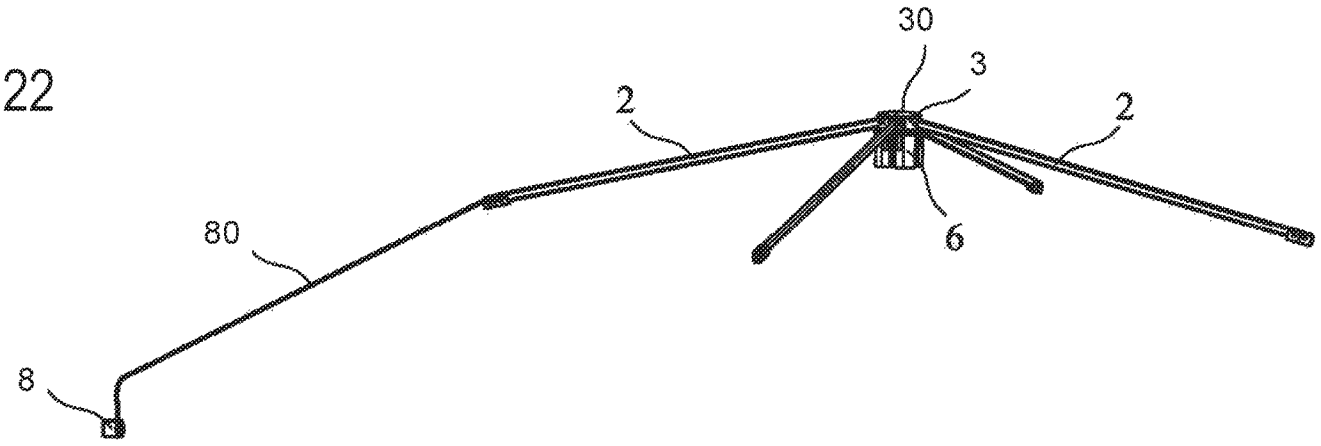
FIG. 22 is a schematic view illustrating some components of a tent frame in accordance with exemplary embodiments of the present invention.
Figure 23:
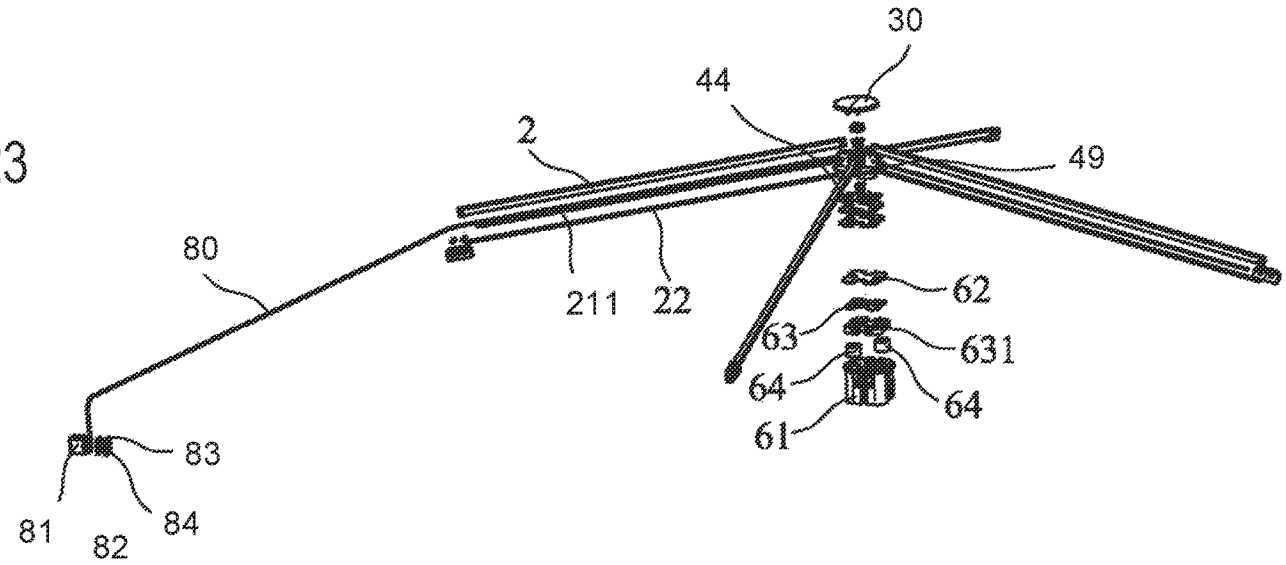
FIG. 23 is a schematic and partially disassembled view illustrating some components of a tent frame in accordance with exemplary embodiments of the present invention.

In some embodiments, a tent frame of the present invention includes other additional or optional components to meet user's additional needs or preference. For instance, in some embodiments, the tent frame includes a speaker such as a Bluetooth speaker. The speaker can be powered by an external power source through the external power interface or by a battery set integrated or coupled with the control box. By way of example, FIGS. 22 and 23 illustrate a tent frame of the present invention including external power interface 8, and Bluetooth speaker 6. Bluetooth speaker 6 is disposed below control box 4 when the tent frame is unfolded and coupled with control box 4. In some embodiments, Bluetooth speaker 6 includes speaker PCB board 63 and one, two or more speakers 64 connected to the speaker PCB board. Speaker PCB board 63 is electrically connected to external power interface PCB board 82 of external power interface 8, for example, via second electrical line 80. In some embodiments, Bluetooth speaker 6 further includes speaker upper cover 62 configured to be coupled with control box 4 (e.g., control casing 49 of control box 4), and speaker outer casing 61 with speaker PCB board 63 disposed within. Speaker outer casing 61 is configured to be engaged with speaker upper cover 62. In an embodiment, speaker PCB board also includes PCB mounting plate 631 disposed in the speaker outer casing for mounting the speaker PCB board. In some embodiments, Bluetooth speaker 6 is wirelessly connected to a mobile device, such as smart phones, other types of cell phones and tablets, which controls the play of the Bluetooth speaker via Bluetooth technology.

As disclosed herein, the tent frame of the present invention includes one or more illumination supporting poles to provide illumination when desired. The illumination supporting pole is configured in such a way (e.g., with the illumination source in the supporting pole) that it does not affect the overall appearance and setup of the tent frame and the tent. In some cases, the illumination is to be powered by a safely packaged and easily replaceable battery set. In some cases, the illumination is to be powered by an external power source, eliminating batteries and thus making the use of the tent more environmentally friendly. In some cases, the illumination is to be powered by either a battery set, or an external power source, or a combination of a battery set and an external power source, increasing the usability of the tent frame. It is more convenient and flexible. The tent frame of the present invention also includes additional or optional components (e.g., Bluetooth speaker), providing additional capabilities to meet users' needs and preferences.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "upward" or "downward", 'inner" or "outer", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. A tent frame with illumination, comprising:

a plurality of upper supporting poles comprising one or more illumination supporting poles, each illumination supporting pole comprising:

an illumination groove elongated along a longitudinal direction of the illumination supporting pole, and at a lower side of the illumination supporting pole when the tent frame is unfolded; and an illumination source disposed in the elongated illumination groove;

a first connector pivotally connecting the plurality of upper supporting poles;

a control box controlling operation of the illumination source of each illumination supporting pole, wherein the control box is disposed below the first connector when the tent frame is unfolded;

the control box comprises a first printed circuit board (PCB) electrically coupled to the illumination source of each illumination supporting pole;

the control PCB board of the control box is configured to be electrically connected to a battery set, an external power source, or a combination of the battery set and the external power source; and the control box comprises a control casing coupled with the first connector, wherein the control PCB board is disposed in the control casing; and a battery box disposed below the control box when the tent is unfolded, wherein the battery box comprises:

a battery outer casing coupled to the control casing of the control box and comprising a rotatable knob; and a battery inner part insertable into and removable from the battery outer casing from a bottom of the battery outer casing, wherein the battery inner part comprises an opening to allow the rotatable knob to pass through, and a plurality of battery compartments disposed around the opening, each for housing a battery of the battery set, wherein the rotatable knob is configured to abut a bottom of the battery inner part, thereby releasably coupling the battery inner part with the battery outer casing.

2. The tent frame of claim 1, wherein each illumination supporting pole further comprises a translucent cover coupled with the elongated illumination groove to encase the illumination source.

3. The tent frame of claim 1, wherein the illumination source is an LED lighting strip.

4. The tent frame of claim 1, wherein the plurality of upper supporting poles comprises four illumination supporting poles.

5. The tent frame of claim 1, wherein the control box further comprises a control button to control the operation of the illumination source of each illumination supporting pole.

6. The tent frame of claim 1, wherein the control box further comprises a mounting plate, wherein the control PCB board is fixedly coupled to the mounting plate.

7. The tent frame of claim 1, further comprising a remote control wirelessly connected to the control box to control the operation of the illumination source of each illumination supporting pole.

8. The tent frame of claim 1, further comprising a top cover disposed above the first connector and coupled to the first connector.

9. A tent frame with illumination, comprising:

a plurality of upper supporting poles comprising one or more illumination supporting poles, each illumination supporting pole comprising:

an illumination groove elongated along a longitudinal direction of the illumination supporting pole, and at a lower side of the illumination supporting pole when the tent frame is unfolded; and an illumination source disposed in the elongated illumination groove;

a first connector pivotally connecting the plurality of upper supporting poles; and a control box controlling operation of the illumination source of each illumination supporting pole, wherein the control box is disposed below the first connector when the tent frame is unfolded;

the control box comprises a first printed circuit board (PCB) electrically coupled to the illumination source of each illumination supporting pole;

the control PCB board of the control box is configured to be electrically connected to a battery set, an external power source, or a combination of the battery set and the external power source;

the illumination source of each illumination supporting pole comprises a first interface at an end adjacent the first connector;

the first connector comprises a receiving compartment at a lower side of the first connector;

the control box comprises a protrusion compartment; and corresponding to the illumination source of each illumination supporting pole, the control box further comprises:

a second interface disposed at the protrusion compartment of the control box; and a first electrical line connecting the control PCB board with the second interface, wherein the first interface of the illumination source of each illumination supporting pole is electrically connected to the corresponding second interface disposed in the protrusion compartment of the control box.

10. The tent frame of claim 9, wherein the protrusion compartment is formed at an upper side of the control box and configured to be coupled with the receiving compartment of the first connector, wherein the control box further comprises:

a passage connected to the protrusion compartment to allow the first electrical line pass through;

a plurality of battery compartments, each for housing a battery of the battery set, wherein the plurality of the battery compartments is disposed circumferentially around the passage; and a plurality of battery covers, each rotatably coupled with a corresponding battery compartment at a first side thereof and releasably coupled with the corresponding battery compartment at a second side thereof.

11. The tent frame of claim 9, wherein the control box further comprises:

a control inner part comprising a plurality of battery compartments disposed circumferentially around the protrusion compartment, each for housing a battery of the battery set; and a control outer casing covering the control inner part and batteries housed in the battery compartments, and removably coupled with the first connector.

12. The tent frame of claim 11, wherein:

the first connector comprises a sliding groove, and a stopper disposed at an outer side of the sliding groove; and the control outer casing comprises a positioning button at an upper outer side thereof and slidable along the sliding groove of the first connector, wherein the positioning button comprises a positioning protrusion configured to be releasably coupled with the stopper of the first connector.

13. The tent frame of claim 11, wherein the control box further comprises a control button under the control PCB board to control the operation of the illumination source of each illumination supporting pole, wherein the push button is accessible from outside of the control outer casing.

14. A tent frame with illumination, comprising:

a plurality of upper supporting poles comprising one or more illumination supporting poles, each illumination supporting pole comprising:

an illumination groove elongated along a longitudinal direction of the illumination supporting pole, and at a lower side of the illumination supporting pole when the tent frame is unfolded; and an illumination source disposed in the elongated illumination groove;

a first connector pivotally connecting the plurality of upper supporting poles; and a control box controlling operation of the illumination source of each illumination supporting pole, wherein the control box is disposed below the first connector when the tent frame is unfolded;

the control box comprises a first printed circuit board (PCB) electrically coupled to the illumination source of each illumination supporting pole;

the control PCB board of the control box is configured to be electrically connected to a battery set, an external power source, or a combination of the battery set and the external power source; and an external power interface for connecting with the external power source, wherein the external power interface is configured to be mounted at one of the plurality of upper supporting poles or at a lower supporting pole, and comprises an external power interface PCB board electrically connected with the control PCB board of the control box.

15. The tent frame of claim 14, wherein the external power interface PCB board comprises a USB interface for connecting with the external power source.

16. The tent frame of claim 14, wherein the external power source is a mobile power pack or a solar cell.

17. The tent frame of claim 14, wherein the external power interface further comprises:

an interface outer casing for housing the external power interface PCB board; and a second electrical line connecting the external power interface PCB board of the external power interface with the control PCB board of the control box, thereby providing power supply to the control box.

18. The tent frame of claim 17, wherein the external power interface further comprises:

an interface push button for controlling the power supply to the control box, the interface push button disposed on a side of the external power interface PCB board and corresponding to a switch on the external power interface PCB board; and additionally or optionally, an interface cover disposed on an outer side of the interface push button and coupled with the interface outer casing.

19. The tent frame of claim 14, further comprising a Bluetooth speaker disposed below the control box, wherein the Bluetooth speaker comprises a speaker PCB board electrically connected to the external power interface PCB board of the external power interface, and one or more speakers connected to the speaker PCB board.

20. The tent frame of claim 19, wherein the Bluetooth speaker further comprises:

a speaker upper cover coupled with the control box;

a speaker outer casing coupled with the speaker upper cover; and a PCB mounting plate disposed in the speaker outer casing, wherein the speaker PCB board is mounted on the mounting plate.

21. The tent frame of claim 20, wherein the Bluetooth speaker is wirelessly connected to a mobile device, wherein the mobile device controls a play of the Bluetooth speaker via Bluetooth technology.

* * * * *